US009157172B2

(12) United States Patent
Tokoro et al.

(10) Patent No.: US 9,157,172 B2
(45) Date of Patent: Oct. 13, 2015

(54) METHOD FOR PRODUCING CARBON-FIBER BUNDLES

(75) Inventors: Yasuhito Tokoro, Hiroshima (JP); Tomoyuki Kotani, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 452 days.

(21) Appl. No.: 13/812,067

(22) PCT Filed: Jul. 26, 2011

(86) PCT No.: PCT/JP2011/066965
§ 371 (c)(1),
(2), (4) Date: Jan. 24, 2013

(87) PCT Pub. No.: WO2012/014892
PCT Pub. Date: Feb. 2, 2012

(65) Prior Publication Data

US 2013/0119572 A1 May 16, 2013

(30) Foreign Application Priority Data

Jul. 27, 2010 (JP) ..... 2010-167911
Mar. 28, 2011 (JP) ..... 2011-069896

(51) Int. Cl.
*B28B 11/08* (2006.01)
*D01F 9/12* (2006.01)
*D01F 9/32* (2006.01)
(Continued)

(52) U.S. Cl.
CPC *D01F 9/12* (2013.01); *B65H 57/14* (2013.01); *B65H 57/16* (2013.01); *D01F 9/32* (2013.01); *B65H 2701/314* (2013.01); *B65H 2701/38* (2013.01)

(58) Field of Classification Search
CPC .... B29C 51/08; B29C 51/082; B29C 51/087; C04B 35/83
USPC ..... 264/291, 292, 1.28, 627, 639, 640, 264/29.2, 29.5, 29.6, 29.7
See application file for complete search history.

(56) References Cited

FOREIGN PATENT DOCUMENTS

CN 101112980 A 1/2008
CN 101260575 A 9/2008
(Continued)

OTHER PUBLICATIONS

Database WPI, Thomson Scientific, Accession No. 2009-K09453, Jilin Jiyan High Sci & Technologiy Fibre Co., Ltd., May 27, 2009.
(Continued)

*Primary Examiner* — Stella Yi
(74) *Attorney, Agent, or Firm* — Morgan, Lewis & Bockius LLP

(57) ABSTRACT

The invention provides a method for producing carbon fiber bundles excellent in productivity without impairing the quality in the process for producing carbon fibers. The method includes a flame-retarding step, a precarbonization step, and a carbonization step. When traveling pitches of the fiber bundles in the flame-retarding step, precarbonization step and carbonization step are represented by P1, P2 and P3, respectively, $0.8 \leq P2/P1 \leq 1.0$ and $0.4 \leq P3/P1 \leq 0.8$ are satisfied; when traveling pitches of the fiber bundles at the inlet and the outlet of a heat treatment section of a precarbonization furnace are represented by P11 and P12, respectively, $0.40 \leq (P12/P11) \leq 0.90$ is satisfied; or when traveling pitches of the fiber bundles at the inlet and the outlet of a heat treatment section of a carbonization furnace are represented by P13 and P14, $0.40 \leq (P14/P13) \leq 0.90$ is satisfied.

14 Claims, 4 Drawing Sheets

(51) Int. Cl.
*B65H 57/14* (2006.01)
*B65H 57/16* (2006.01)

(56) References Cited

FOREIGN PATENT DOCUMENTS

| | | |
|---|---|---|
| CN | 201245730 | 5/2009 |
| GB | 1300239 | 12/1972 |
| JP | 59-53719 | 3/1984 |
| JP | 3047695 | 3/2000 |
| JP | 2003-55843 | 2/2003 |
| JP | 2008-19526 | 1/2008 |

OTHER PUBLICATIONS

European Search Report for Application No. 11812481 dated Nov. 15, 2013.
Office Action issued in counterpart Chinese Patent Application No. 201180036477.X dated Feb. 7, 2014 (partial translation).

METHOD FOR PRODUCING CARBON-FIBER BUNDLES

BACKGROUND OF THE INVENTION

1. Field of the Invention

The present invention relates to a method for producing carbon fiber bundles.

2. Description of the Related Art

Carbon fiber bundles are usually produced by carbonization as follows: acrylic fiber bundles as precursors for the carbon fiber bundles are subjected to a so-called flame-retarding treatment in which the acrylic fiber bundles are passed through an oxidizing atmosphere oven (hereinafter, referred to as a flame-retarding oven) set at from 200 to 300° C.; then the flame-retardant fiber bundles are sequentially passed for carbonization through an inert atmosphere furnace (hereinafter, referred to as an precarbonization furnace) with the highest treatment temperature of from 500 to 800° C. and another inert atmosphere furnace (hereinafter, referred to as a carbonization furnace) with the highest treatment temperature exceeding 1000° C. Moreover, where necessary, by passing for graphitization the carbon fiber bundles through an inert atmosphere furnace (hereinafter, referred to as a graphitization furnace) in which the highest treatment temperature exceeds 2000° C., high-elasticity graphitized fiber bundles can be produced.

In the flame-retarding oven, the precursor fiber bundles are heat-treated in the oxidizing atmosphere, and hence the precursor fiber bundles undergo oxidation reaction to generate heat. A heat treatment temperature of the flame-retarding oven is set at as low as 200 to 300° C., lest the heat of the reaction should be stored inside the fiber bundles to take fire, and hence a long time heat treatment is required for the purpose of obtaining predetermined flame-retardant fiber bundles.

In the case where a demand for carbon fibers is increased and the production amount is intended to be increased, a multitude of fiber bundles are simultaneously fed to the oven or a baking rate is increased. However, for the purpose of increasing a production capacity by simultaneously feeding a multitude of fiber bundles, a long time treatment at a lower temperature is required, lest the heat of the reaction should be stored inside the fiber bundles to take fire, and hence such a method as simultaneously treating a multitude of fiber bundles has its own limits. An increase of the production capacity due to an increase of the baking rate may be attained by increasing the length of the precursor fiber bundles traveling in the flame-retarding oven. For the purpose of increasing the length of the precursor fiber bundles traveling in the flame-retarding oven, there is usually adopted a method in which the precursor fiber bundles are once allowed to go to outside the flame-retarding oven, and then are repeatedly passed through the flame-retarding oven in a manner turned over by turn-over rolls disposed outside the flame-retarding oven.

The flame-retardant fiber bundles completed in the heat treatment in the flame-retarding oven are treated in the precarbonization furnace, filled with an inert gas atmosphere so as for the fiber bundles not to be oxidized, with the highest treatment temperature of from 500 to 800° C., then continuously passed through the carbonization furnace in which in an inert gas atmosphere filled therein, the precarbonized fiber bundles are treated with the highest treatment temperature exceeding 1000° C., and thus converted into carbon fiber bundles. The fiber bundles being converted into carbon fiber bundles are extremely weak, a partial breakage occurs in the fiber bundles to generate fluff of the fiber bundles, in an extreme case the fiber bundles themselves are cut, and hence traveling of the fiber bundles is required to be carefully performed. Additionally, in this process, the heat treatment is usually completed in one pass because of the following and other reasons: the conversion into carbon fiber bundles occurs in an extremely short time; the temperature increase rate of the fiber bundles significantly affects the quality of the carbon fiber bundles; decomposed products occur in large amounts in the stage of conversion into the carbon fiber bundles and hence the repeated passage of the fiber bundles through the inside of the furnace contaminates the fiber bundles with such decomposed products to offer the causes to degrade the quality of the fiber bundles. In the case where the demand for carbon fibers is increased and the production amount is intended to be increased, the baking rate is increased or a multitude of fiber bundles are simultaneously fed to the furnace. The increase of the production capacity based on the increase of the baking rate leads to the extension of the furnace length and such extension is limited, and hence a multitude of fiber bundles may be simultaneously fed to the furnace.

Patent Literature 1 discloses a method for producing with satisfactory productivity carbon fibers having good quality by decreasing tow width according to a density increase of acrylonitrile-based precursor fibers. In this method, however, the traveling pitch of the precursor fibers is sometimes decreased in the flame-retarding step, and hence the heat storage due to the heat of reaction, inside the fiber bundles, sometimes cannot be removed.

Accordingly, such a method that the treatment temperature is increased, as usually performed, in the flame-retarding step according to the density increase of the precursor fibers sometimes cannot be performed, and thus the flame-retarding treatment sometimes takes a long time, as a result, the productivity is sometimes rather degraded.

Patent Literature 2 discloses a method in which heat efficiency is increased as follows: a multitude of flame-retardant fiber bundles discharged from the flame-retarding oven are divided into a plurality of groups of fiber bundles, each of the groups are brought closer to each other with respect to the horizontal direction and each of the groups forms a tier with respect to the vertical direction, accordingly the shape of the inlet of the carbonization furnace, for feeding the flame-retardant fiber bundles, is not made flat in shape, and thus the heat efficiency is increased. In this method, however, the heating conditions are sometimes vertically varied among the groups of fiber bundles, vertically divided into a plurality of stages, and accordingly the physical properties of the carbon fiber bundles may be varied among the carbon fiber bundle groups and the quality of the carbon fiber bundles may be unstable.

PRIOR ART LITERATURES

Patent Literatures

Patent Literature 1: JP 2008-19526 A
Patent Literature 2: JP 3047695 B

SUMMARY OF THE INVENTION

Problems to be Solved by the Invention

An object of the present invention is to provide a method for producing carbon fiber bundles, wherein the method allows to avoid size increase of the high temperature furnaces (the precarbonization furnace and the carbonization furnace) used in the precarbonization step and the carbonization step, which size increase is accompanied with the increase of the number of fiber bundles, the method is high in productivity with respect to the equipment cost and the energy, and the quality of the carbon fiber bundles is stable.

Means for Solving the Problems

A first aspect of the present invention provides a method for producing carbon fiber bundles, including: a flame-retarding step of converting a plurality of precursor fiber bundles into flame-retardant fiber bundles by heat treating the plurality of precursor fiber bundles in an oxidizing gas atmosphere at from 200 to 300° C. in a state that the plurality of precursor fiber bundles are lined up side by side in parallel to each other; a precarbonization step of converting the flame-retardant fiber bundles into precarbonization-treated fiber bundles by heat treating the flame-retardant fiber bundles in an inert gas atmosphere with the highest treatment temperature of from 500 to 800° C. in a state that the flame-retardant fiber bundles are lined up side by side in parallel to each other; and a carbonization step of converting the precarbonization-treated fiber bundles into carbon fiber bundles by heat treating the precarbonization-treated fiber bundles in an inert gas atmosphere with the highest treatment temperature of 1000° C. or higher in a state that the precarbonization-treated fiber bundles are lined up side by side in parallel to each other, wherein when the traveling pitch of the fiber bundles in the flame-retarding step is represented by P1, the traveling pitch of the fiber bundles in the precarbonization step is represented by P2, and the traveling pitch of the fiber bundles in the carbonization step is represented by P3, the following relations are satisfied:

$$0.8 \leq P2/P1 \leq 1.0 \quad (1)$$

$$0.4 \leq P3/P1 \leq 0.8 \quad (2)$$

The method for producing carbon fiber bundles preferably further includes: (a) a step of making smaller the traveling pitch of fiber bundles present in each of 2 or more and 20 or less fiber bundle blocks, said fiber bundle blocks being subgroups of the flame-retardant fiber bundles obtained from the flame-retarding step, or being subgroups of the precarbonization-treated fiber bundles obtained from the precarbonization step, or being subgroups of each of the flame-retardant fiber bundles and the precarbonization-treated fiber bundles; and (b) a step of bringing adjacent fiber bundle blocks closer to each other, for all the fiber bundle blocks made smaller in the traveling pitch of the fiber bundles in the step (a).

In the step (a), it is possible to use a grooved roll or a comb guide for the purpose of decreasing the traveling pitch.

The step (a) is preferably performed with use of two rolls disposed parallel to each other.

Preferably, in the step (a), at least two rolls disposed parallel to each other are used for decreasing the traveling pitch, wherein a comb guide is used in addition to the two rolls, or a grooved roll is used as at least one of the two rolls.

Preferably, the step (a) is performed with use of two rolls disposed parallel to each other, wherein the maximum inclination angle of the fiber bundles in each of the fiber bundle blocks traveling between the two rolls, in relation to a plane perpendicular to the axis directions of the two rolls, is set at larger than 0.1° and smaller than 3.0°.

A distance between the two rolls disposed parallel to each other, used in the step (a) is preferably 750 mm or more.

Preferably, the step (b) is performed with use of a plurality of angle-adjustable second roll pairs disposed between a first roll pair, wherein each roll pair of the first roll pair and the second roll pairs consists of two rolls disposed parallel to each other, and the maximum inclination angle among inclination angles of all the fiber bundle blocks traveling between the second roll pairs, in relation to a plane perpendicular to the axes of the two rolls constituting the first roll pair, is set at smaller than 20°.

A second aspect of the present invention is a method for producing carbon fiber bundles, including: a flame-retarding step of converting a multitude of precursor fiber bundles into flame-retardant fiber bundles by heat treating in a flame-retarding oven the multitude of precursor fiber bundles in an oxidizing gas atmosphere at from 200 to 300° C. in a state that the multitude of precursor fiber bundles are lined up side by side; a precarbonization step of converting the flame-retardant fiber bundles into precarbonization-treated fiber bundles by heat treating in a precarbonization furnace the flame-retardant fiber bundles in an inert gas atmosphere with the highest treatment temperature of from 500 to 800° C. in a state that the flame-retardant fiber bundles are lined up side by side; and a carbonization step of converting the precarbonization-treated fiber bundles into carbon fiber bundles by heat treating in a carbonization furnace the precarbonization-treated fiber bundles in an inert gas atmosphere with the highest treatment temperature of 1000° C. or higher in a state that the precarbonization-treated fiber bundles are lined up side by side, wherein when the traveling pitch of the fiber bundles at the inlet of a heat treatment section of the precarbonization furnace is represented by P11, and the traveling pitch of the fiber bundles at the outlet of the heat treatment section of the precarbonization furnace is represented by P12, the following relation is satisfied:

$$0.40 \leq (P12/P11) \leq 0.90 \quad (3)$$

Preferably, the traveling pitch of the fiber bundles traveling in the heat treatment section of the precarbonization furnace is altered with use of two rolls parallel to each other, respectively disposed on the inlet side and the outlet side of the precarbonization furnace, wherein the maximum inclination angle among inclination angles of the multitude of fiber bundles, lined up side by side, traveling between the two rolls, in relation to a plane perpendicular to the axis directions of the two rolls, is set at larger than 0.1° and smaller than 3.0°.

When the traveling pitch of the fiber bundles at the inlet of a heat treatment section of the carbonization furnace is represented by P13, and the traveling pitch of the fiber bundles at the outlet of the heat treatment section of the carbonization furnace is represented by P14, the following relation is preferably satisfied:

$$0.40 \leq (P14/P13) \leq 0.90 \quad (4)$$

Further preferably, in this case, the traveling pitch of the fiber bundles traveling in the heat treatment section of the carbonization furnace is altered with use of two rolls parallel to each other, respectively disposed on the inlet side and the outlet side of the carbonization furnace, wherein the maximum inclination angle among inclination angles of the multitude of fiber bundles, lined up side by side, traveling between these two rolls, in relation to a plane perpendicular to the axis directions of these two rolls, is set at larger than 0.1° and smaller than 3.0°.

A third aspect of the present invention is a method for producing carbon fiber bundles, including: a flame-retarding step of converting a multitude of carbon fiber precursor fiber bundles into flame-retardant fiber bundles by heat treating in a flame-retarding oven the multitude of carbon fiber precursor fiber bundles in an oxidizing gas atmosphere at from 200 to 300° C. in a state that the multitude of carbon fiber precursor fiber bundles are lined up side by side; a precarbonization step of converting the flame-retardant fiber bundles into precarbonization-treated fiber bundles by heat treating in a precarbonization furnace the flame-retardant fiber bundles in an inert gas atmosphere with the highest treatment temperature of from 500 to 800° C. in a state that the flame-retardant fiber bundles are lined up side by side; and a carbonization step of converting the precarbonization-treated fiber bundles into carbon fiber bundles by heat treating in a carbonization furnace the precarbonization-treated fiber bundles in an inert gas atmosphere with the highest treatment temperature of 1000° C. or higher in a state that the precarbonization-treated fiber bundles are lined up side by side, wherein when the traveling pitch of the fiber bundles at the inlet of a heat treatment section of the carbonization furnace is represented by P13, and the traveling pitch of the fiber bundles at the outlet of the heat treatment section of the carbonization furnace is represented by P14, the following relation is satisfied:

$$0.40 \leq (P14/P13) \leq 0.90 \quad (4)$$

Preferably, the traveling pitch of the fiber bundles traveling in the heat treatment section of the carbonization furnace is altered with use of two rolls parallel to each other, respectively disposed on the inlet side and the outlet side of the carbonization furnace, wherein the maximum inclination angle among inclination angles of the multitude of fiber bundles, lined up side by side, traveling between the two rolls, in relation to a plane perpendicular to the axis directions of the two rolls, is set at larger than 0.1° and smaller than 3.0°.

Advantages of the Invention

The present invention can provide a method for producing carbon fiber bundles, wherein the method allows to avoid size increase of the high temperature furnaces (the precarbonization furnace and the carbonization furnace) used in the precarbonization step and the carbonization step, which size increase is accompanied with the increase of the number of fiber bundles, the method is high in productivity with respect to the equipment cost and the energy, and the quality of the carbon fiber bundles is stable.

EMBODIMENTS FOR CARRYING OUT THE INVENTION

The inventors made a study of the rational means for achieving the aforementioned objects, and consequently have reached a first aspect of the present invention by discovering that the aforementioned objects can be achieved by altering the traveling pitch of the fiber bundles between the flame-retarding step and the precarbonization step and/or between the precarbonization step and the carbonization step.

Figure 2:
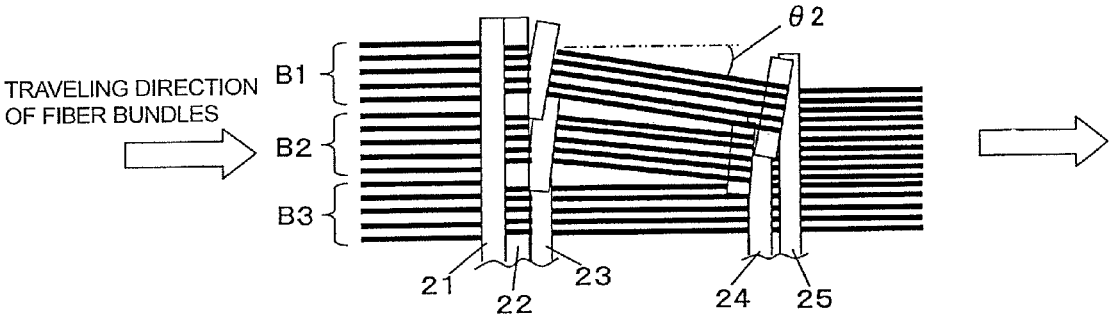
FIG. 2 is a partial schematic plane view of an apparatus capable of being used in the steps (a) and (b) according to the first aspect of the present invention (the fiber bundle blocks shown in FIG. 1 are partially illustrated)

Specifically, in the flame-retarding step in which the precursor fiber bundles generate heat due to the oxidation reaction, broken fiber bundles may overlap with adjacent fiber bundles at the time of breakage and may take fire, and hence the traveling pitch is preferably such that broken fiber bundles do not overlap with the adjacent fiber bundles, and preferable is an arrangement in which the fiber bundles are arranged at equal intervals in the axis direction of a roll (for example, a flat roll 21 in FIG. 2). On the other hand, in the precarbonization step and the carbonization step, in each of which a treatment is performed in an inert atmosphere, it is acceptable for broken fiber bundles to overlap with the adjacent fiber bundles, and hence the traveling pitch of the fiber bundles can be made narrower than in the flame-retarding step. However, in the precarbonization step, a lot of decomposed products are generated at the stage of the conversion from the flame-retardant fiber bundles into the carbonized fiber bundles, and if the decomposed products remain in the fiber bundles, the quality may be affected, and hence the traveling pitch of the fiber bundles cannot be made extremely narrow. On the other hands, in the carbonization step, the generation of decomposed products is small in amount, and accordingly, it has been revealed that even when the traveling pitch is made further narrower than in the precarbonization step, none of the quality, the operation and the structure of the apparatus is affected.

The method for producing carbon fiber bundles, according to a first aspect of the present invention includes the following steps: a flame-retarding step of converting a plurality of precursor fiber bundles into flame-retardant fiber bundles by heat treating the plurality of precursor fiber bundles in an oxidizing gas atmosphere at from 200 to 300° C. in a state that the plurality of precursor fiber bundles are lined up side by side in parallel to each other; a precarbonization step of converting the flame-retardant fiber bundles into precarbonization-treated fiber bundles by heat treating the flame-retardant fiber bundles in an inert gas atmosphere with the highest treatment temperature of from 500 to 800° C. in a state that the flame-retardant fiber bundles are lined up side by side in parallel to each other; and a carbonization step of converting the precarbonization-treated fiber bundles into carbon fiber bundles by heat treating the precarbonization-treated fiber bundles in an inert gas atmosphere with the highest treatment temperature of 1000° C. or higher in a state that the precarbonization-treated fiber bundles are lined up side by side in parallel to each other.

In the method for producing carbon fiber bundles, according to the first aspect of the present invention, when the traveling pitch of the fiber bundles in the flame-retarding step is represented by P1, the traveling pitch of the fiber bundles in the precarbonization step is represented by P2, and the traveling pitch of the fiber bundles in the carbonization step is represented by P3, the following relations are satisfied:

$$0.8 \leq P2/P1 \leq 1.0 \quad (1)$$

$$0.4 \leq P3/P1 \leq 0.8 \quad (2)$$

It is to be noted that the number of the fiber bundles remains unchanged throughout these steps.

Hereinafter, the embodiment of the first aspect of the present invention is described in detail with reference to FIGS. 1 to 5; however, the present invention is not limited to this embodiment.

First, about 100 to 2000 precursor fiber bundles are lined up side by side in a form of a sheet to prepare a sheet-like set of precursor fiber bundles (11), and are flame-retarded in a flame-retarding oven (1) to prepare flame-retardant fiber bundles (12). A multitude of fiber bundles lined up side by side form a plane, and these fiber bundles are referred to as a sheet-like set of fiber bundles.

Figure 1:
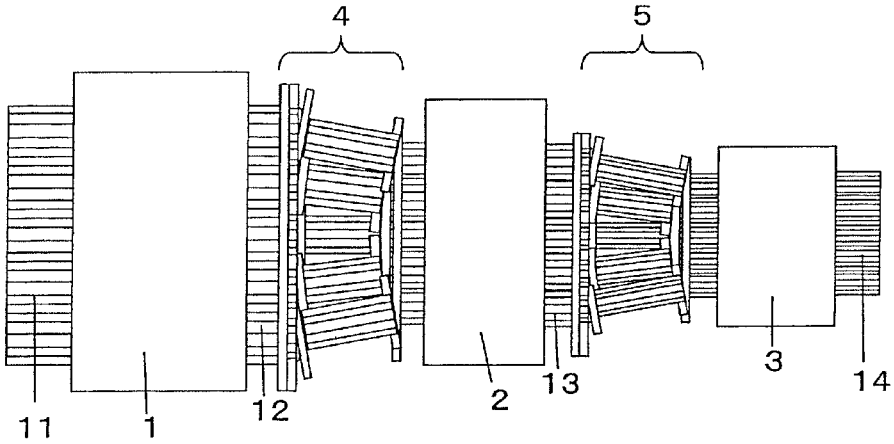
FIG. 1 is a schematic plane view of an apparatus capable of being used in an embodiment of a method for producing carbon fiber bundles according to a first aspect of the present invention.

Specifically, for example, as shown in FIG. 1, first, the sheet-like set of precursor fiber bundles (11) is formed as follows: a plurality of precursor fiber bundles unraveled from a cheese (not shown) hung on a creel stand are arranged with a guide (not shown) at equal intervals in parallel to each other so as to form a single and the same plane. The guide is appropriately disposed in such a way that the equal interval state and the parallel state of the precursor fiber bundles are able to be maintained. Examples of a type of the guide include a grooved roll on the surface of which grooves are engraved at equal intervals and a guide in which pins are arranged at equal intervals.

As the plurality of precursor fiber bundles, precursor fiber bundles such as acrylic precursor fiber bundles and pitch based precursor fiber bundles can be used. The diameters, the number and the like of the precursor fiber bundles can be appropriately set according to the diameter and the productivity of the produced carbon fiber bundles. The traveling pitch (P1) in the flame-retarding oven, of the precursor fiber bundles in the sheet-like set of precursor fiber bundles (11) is the pitch obtained when the precursor fiber bundles are arranged at equal intervals with a guide (not shown) provided outside the flame-retarding oven (1), and is represented by the average value of the measured values of the center-to-center spacings in width direction between the adjacent precursor fiber bundles on a roll (not shown) disposed on the inlet side of the flame-retarding oven (1). When the roll disposed on the inlet side is a grooved roll, the pitch of the grooves is the traveling pitch (P1) in the flame-retarding oven. The traveling pitch (P2) in the precarbonization furnace and the traveling pitch (P3) in the carbonization furnace are also similarly represented by the average values of the values measured respectively on the rolls (not shown) disposed on the inlet sides of the precarbonization furnace (2) and the carbonization furnace (3). The traveling pitch (P1) of the fiber bundles in the flame-retarding oven is preferably 4 mm or more and 20 mm or less from the viewpoint of productivity and prevention of heat storage. For example, when the traveling pitch of the fiber bundles is 4 mm, it is meant that the center-to-center spacings (distances) between the adjacent fiber bundles in the width direction (in FIG. 1, the up-down direction in the plane of paper) are 4 mm.

Next, the sheet-like set of precursor fiber bundles (11) is fed to the flame-retarding oven (1). The sheet-like set of precursor fiber bundles (11) travels in the flame-retarding oven (1) of an oxidizing gas atmosphere, wherein the sheet-like set of precursor fiber bundles (11) is flame-retarded, and then once goes to outside the flame-retarding oven (1). Next, the sheet-like set of precursor fiber bundles (11) is turned over by the first turn-over roll of a turn-over roll group (not shown) provided outside the flame-retarding oven (1). Then, the sheet-like set of precursor fiber bundles (11) again passes through the flame-retarding oven (1) to be subjected to flame-retarding treatment. Subsequently, the sheet-like set of precursor fiber bundles (11) is repeatedly subjected to flame-retarding treatment between the turn-over rolls of the turn-over roll group. Thus, a sheet-like set of flame-retardant fiber bundles (12) is obtained. The oxidizing gas atmosphere is not particularly limited as far as the atmosphere is oxidative, and air is usually used as the oxidizing gas atmosphere from the viewpoint of economic efficiency.

The heat treatment temperature of the flame-retarding oven (1) is preferably 200° C. or higher and 300° C. or lower from the viewpoint of prevention of heat storage. The flame-retarding treatment time of the flame-retarding oven (1) is preferably 20 minutes or more and 120 minutes or less from the viewpoint of productivity and prevention of heat storage. Conveying speed of the sheet-like set of precursor fiber bundles (11) is preferably 3 m/min or more and 20 m/min or less from the viewpoint of productivity.

Figure 5:
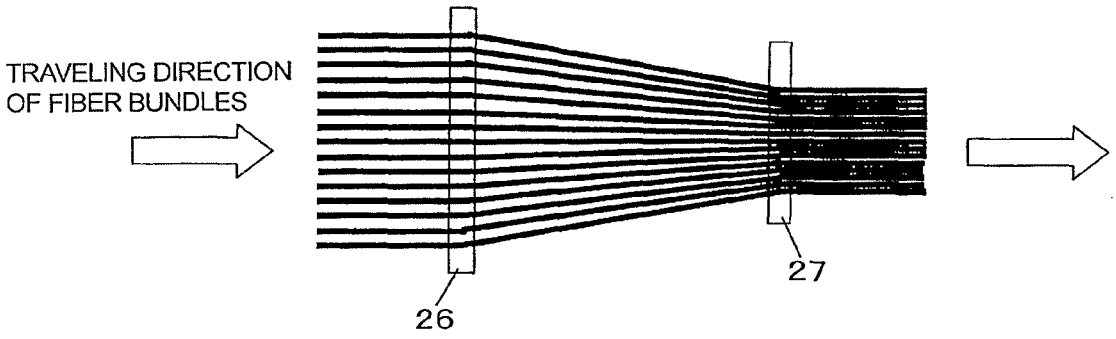
FIG. 5 is a schematic plane view capable of being used in a method for altering the traveling pitch of the fiber bundles with two grooved rolls according to the first aspect of the present invention.

The alteration of the traveling pitch of the fiber bundles has hitherto been performed with use of two grooved rolls as shown in FIG. 5. Accordingly, also in the method for producing carbon fiber bundles of the first aspect of the present invention, for example, for the flame-retardant fiber bundles obtained from the flame-retarding step and/or for the precarbonization-treated fiber bundles obtained from the precarbonization step, the alteration of the traveling pitch of the fiber bundles can be performed in one stage with use of two grooved rolls 26 and 27 shown in FIG. 5.

In the first aspect of the present invention, however, the alteration of the traveling pitch of the fiber bundles is preferably performed with a two-stage traveling pitch alteration method composed of a step (a) and a step (b). The use of this method enables to easily prevent the occurrence of twisting and enables to easily produce carbon fiber bundles being satisfactory in quality.

The step (a) is preferably performed with use of two rolls disposed parallel to each other. In the step (a), for the purpose of decreasing the traveling pitch, a grooved roll or a comb guide can be used. For example, as at least one roll (for example, the roll (21) in FIG. 2) of the aforementioned two rolls, a grooved roll can be used. In addition to the two rolls, a comb guide can also be used.

Hereinafter, an example of the two-stage traveling pitch alteration method is described by taking as an example the flame-retardant fiber bundles obtained from the flame-retarding step.

With use of a roll group (4) consisting of a plurality of rolls disposed perpendicular to traveling direction (arrow direction in FIG. 2) of the fiber bundles and a plurality of angle-adjustable roll pairs, wherein the roll group (4) is disposed between the flame-retarding oven (1) and the precarbonization furnace (2) as shown in FIGS. 1 and 2, the alteration of the traveling pitch of the fiber bundles of the sheet-like set of flame-retardant fiber bundles (12) obtained from the flame-retarding step can be performed. More specifically, the roll group (4) can consist of: a roll pair for the step (a) consisting of the two rolls (21 and 22) for performing step (a), disposed parallel to each other; a first roll pair for performing the step (b); and a plurality of angle-adjustable second roll pairs for performing the step (b). Any pair of the first roll pair and the second roll pairs for the step (b) consists of two rolls disposed parallel to each other; in FIG. 2, the first roll pair consists of the rolls (22) and (25), and the second roll pair consists of the rolls (23) and (24). One roll can be used for dual purposes, both for the roll pair for the step (a) and for the first roll pair for the step (b). In FIG. 2, the roll 22 is used for dual purposes, both for the roll pair for the step (a) and for the first roll pair for the step (b). The two rolls (21 and 22) constituting the roll pair for the step (a) can be respectively disposed perpendicular to the traveling direction (in FIG. 2, the arrow direction) of the multitude of fiber bundles used in the step (a) and lined up side by side, and disposed parallel to a single and the same plane formed by these fiber bundles.

The distance between two rolls constituting the roll pair for step (a) is preferably 750 mm or more for the purpose of preventing the occurrence of twisting in the fiber bundles, and is preferably 20000 mm or less from the viewpoint of the mutual contact of the fiber bundles and workability.

The two rolls (22 and 25) constituting the first roll pair for the step (b) can be disposed parallel respectively to the two rolls (21 and 22) constituting the roll pair for the step (a). The two rolls (23 and 24) constituting the second roll pair for the step (b) can be respectively disposed perpendicular to the traveling direction of the fiber bundles traveling between these two rolls and disposed parallel to a single and the same plane formed by the fiber bundles traveling between these two rolls. The number of the second roll pairs for the step (b) can be determined according to the number of the fiber bundle blocks. In the step (a), a multitude of fiber bundles lined up side by side are divided into two or more subgroups and the traveling pitch is altered for each of the subgroups; the fiber bundle blocks mean such subgroups. In FIG. 2, there are shown three fiber bundle blocks B1, B2 and B3 each representing a single fiber bundle block. In consideration of the productivity of the precarbonization furnace and the effects of the decomposed products on the quality, the traveling pitch of the fiber bundles is determined in such a way that the traveling pitch (P1) of the fiber bundles in the aforementioned flame-retarding step and the traveling pitch (P2) of the fiber bundles in the aforementioned precarbonization step satisfy the relation $0.8 \leq P2/P1 \leq 1.0$.

Figure 3:
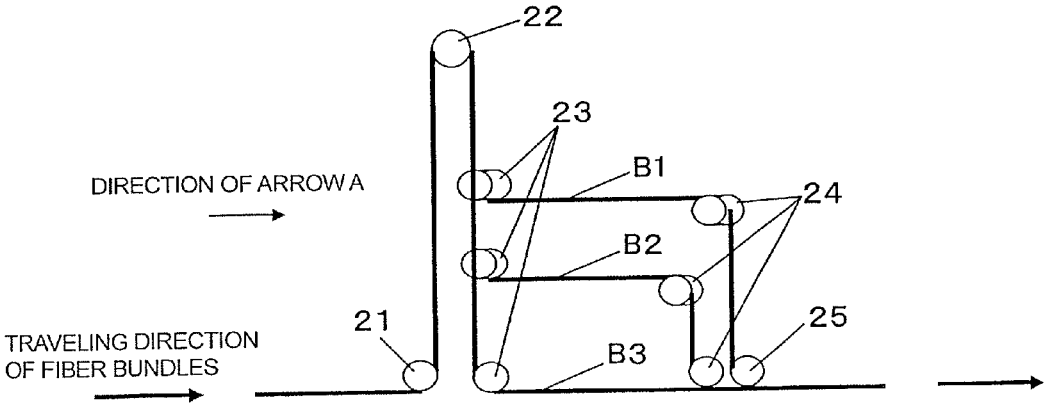
FIG. 3 is a partial schematic side view of an apparatus capable of being used in the steps (a) and (b) according to the first aspect of the present invention.
Figure 4:
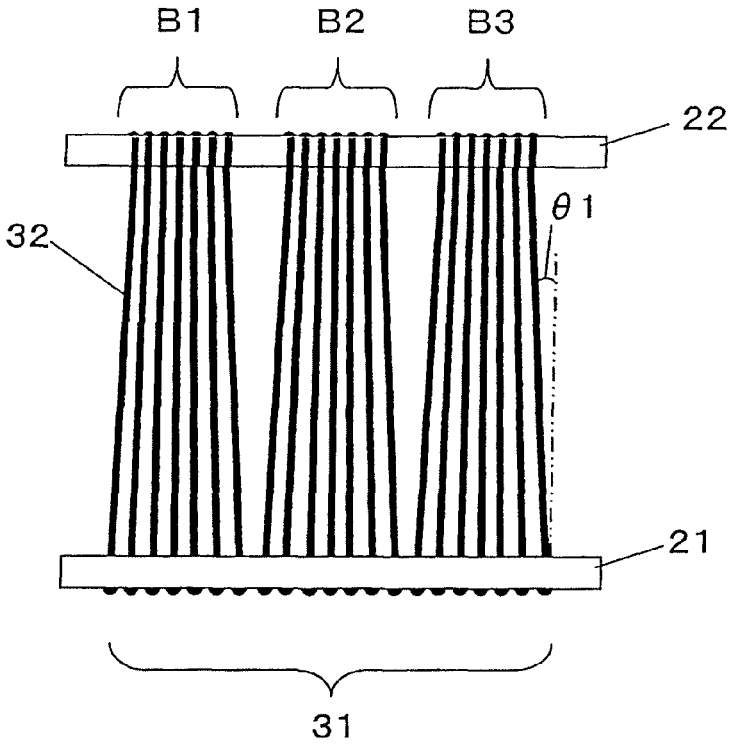
FIG. 4 is a view illustrating an embodiment of the step (a) according to the first aspect of the present invention (a view in the direction of the arrow A shown in FIG. 3)

An example of a method for altering the fiber bundle traveling pitch is described more specifically with reference to FIGS. 2 to 4 (in FIGS. 2 to 4, three blocks of the five fiber bundle blocks shown in FIG. 1 are shown). FIG. 4 shows a view in the direction of the arrow A shown in FIG. 3.

First, the sheet-like set of fiber bundles 31 after the flame-retarding treatment is divided into two or more fiber bundle blocks (B1 to B3) as shown in FIGS. 2 and 4, and the traveling pitch of the flame-retardant fiber bundles in each of the blocks is altered. In other words, in each of the two or more fiber bundle blocks of the sheet-like set of fiber bundles 31 before division, the traveling pitch of the flame-retardant fiber bundles in each of the fiber bundle blocks is altered to be smaller (step (a)). For example, in FIG. 1, the sheet-like set of fiber bundles is divided into five fiber bundle blocks, and hence in each of the five fiber bundle blocks, the traveling pitch of the fiber bundles in the fiber bundle block is altered to be smaller. Of the sheet-like set of flame-retardant fiber bundles (12) after the flame-retarding treatment, the sheet-like group of fiber bundles before the division is particularly represented by the reference numeral 31. In this case, as shown in FIG. 4, the alteration of the traveling pitch of the fiber bundles in each of the blocks, namely, the step (a) is performed with use of the two rolls (21 and 22) disposed parallel to each other, wherein the maximum inclination angle of the fiber bundles (for example, the inclination angle of the fiber bundle 32), in relation to the plane perpendicular to the axes of these two rolls, in each of the fiber bundle blocks (in FIG. 2, in each of the fiber bundle blocks B1, B2 and B3), traveling between these two rolls is preferably set at larger than 0.1° and smaller than 3.0°. Typically, the maximum inclination angle is the inclination angle of a fiber bundle located at either of the edges in each of the fiber bundle blocks. There are two fiber bundles located at the edges in each of the fiber bundle blocks, and the inclination angles of these two fiber bundles may be the same as each other or different from each other. Specifically, for example, the inclination angles of two fiber bundles (one of these fiber bundles is denoted by the reference numeral 32) located at both edges of the fiber bundle block B1 in FIG. 4 may be the same as each other or different from each other. This is also the case for the fiber bundle blocks B2 and B3. In each of the fiber bundle blocks, when the inclination angles of the two fiber bundles located at both edges are the same as each other, the same angle is the maximum inclination angle of the fiber bundles in the fiber bundle block, and when the inclination angles of the two fiber bundles are different from each other, the larger inclination angle of these two inclination angles is the maximum inclination angle. The maximum inclination angles defined for the respective fiber bundle blocks (in FIG. 4, B1 to B3) may be the same in value (in angle) as each other or may be different in value from each other.

In this way, the maximum inclination angle is defined for each of the fiber bundle blocks, and hereinafter, these maximum inclination angles are generally referred to as θ1. There are two fiber bundles located at the edges of each of the fiber bundle blocks; for example, in FIG. 1, the inclination angles of the two fiber bundles located at the edges of each of the fiber bundle blocks are the same in value (in angle), and hence θ1 exists at ten positions (5 (number of the fiber bundle blocks)×2 (number of the edges)). In FIG. 4, one of the ten θ1s in FIG. 1 is shown.

When these inclination angles (θ1) are all larger than 0.1°, the increase of the distance between the roll (21) and the roll (22) can be easily prevented, and the increase of the time duration of the carbon fiber bundle production process can be easily prevented. When these inclination angles (θ1) are all smaller than 3.0°, the occurrence of twisting can be easily prevented. Each of angles of these θ1s is further preferably set at larger than 0.3° and smaller than 2.5°.

With regard to all the fiber bundles, as shown in FIG. 4, in the fiber bundle block constituted with fiber bundles arranged at equal intervals in parallel to each other so as to form a single and the same plane, the inclination angles in relation to the plane perpendicular to the axes of the two rolls constituting the roll pair for the step (a) can be designed as follows. Specifically, the inclination angles of the fiber bundles located at both edges of the fiber bundle block can be designed to be the largest and the inclination angles of the fiber bundles can be designed to be reduced as approaching to the center of the fiber bundle block. In this case, in the inclination angles, in relation to the plane perpendicular to the axis directions of these two rolls, of all the fiber bundles in each of the fiber bundle blocks traveling between these two rolls, the largest angle among these inclination angles is preferably set at larger than 0.1° and smaller than 3.0°, and further preferably set at larger than 0.3° and smaller than 2.5°.

In this case, as shown in FIG. 3, the two rolls (21 and 22) are preferably disposed in such a way that the sheet-like set of flame-retardant fiber bundles (12) traveling between these two rolls travels in the vertical direction because the space can be effectively utilized. Preferably, a flat roll (21) is used as the roll (21) and a grooved roll (22) capable of controlling the traveling pitch of the fiber bundles is used as the roll (22). In place of the grooved roll (22), a structure in which a guide capable of controlling the traveling pitch of the fiber bundles is combined with a flat roll can also be used.

The number of the fiber bundle blocks is varied depending on the total width of the sheet-like set of fiber bundles (31) before the division and the alteration magnitude of the traveling pitch of the fiber bundles; however, the number of the fiber bundle blocks is preferably 2 or more and 20 or less and more preferably 4 or more and 10 or less, for the purpose of preventing the increase of the equipment cost due to the increase of the number of the angle-adjustable second roll pair (23 and 24) performing the below-described alteration (step (b)) of the positions of the fiber bundle blocks.

Hereinafter, the method of the step (b), namely, a method for altering the position of each of all the fiber bundle blocks in the sheet width direction (in FIG. 1, the up-down direction in the plane of paper) in such a way that the adjacent fiber bundle blocks are brought closer to each other, more specifically, a method in which by using the plurality of angle-adjustable roll pairs disposed in such a way that the fiber bundle blocks reduced in the traveling pitch of the fiber bundles in the step (a) are brought closer to each other, the mutual spacings between the fiber bundle blocks are altered and the fiber bundle blocks are rearranged, is explained using FIGS. 2 and 3. When the fiber bundle blocks are brought closer to each other, the fiber bundle blocks are brought closer to each other in such a way that the traveling pitches of all the fiber bundles are the same as the traveling pitch of the fiber bundles in the fiber bundle blocks. All the fiber bundle blocks in the step (b) mean the whole of the fiber bundle blocks in the step (a); when there are five fiber bundle blocks as in FIG. 1, the whole of the five fiber bundle blocks is meant. In other words, in the case of FIG. 1, by the step (b), the adjacent fiber bundle blocks in the five fiber bundle blocks are brought closer to each other. As shown in FIG. 4, by the step (a), the traveling pitches of the fiber bundles in each of the fiber bundle blocks (B1 to B3) are narrowed on the grooved roll (22). As a result, gaps between the fiber bundle blocks are formed. In other words, the state is such that the spacings between the adjacent fiber bundle blocks are wider than the spacings between the adjacent fiber bundles in the fiber bundle blocks. The angle-adjustable rolls (23, 24) are adjusted so that, by the step (b), from this state, the gaps between the fiber bundle blocks (B1 to B3) are narrowed, and the traveling pitches of all the fiber bundles are the same as the traveling pitch of the fiber bundles in the fiber bundle blocks. In other words, by using the plurality of the angle-adjustable second roll pairs (constituted with the roll (23) and the roll (24)) disposed between the first roll pair for the step (b), the mutual gaps between the adjacent fiber bundle blocks (B1 to B3) are narrowed, and thus the traveling pitches of all the fiber bundles are adjusted so as to be the same. In this case, the angle alteration magnitude of each of the fiber bundle blocks (B1 to B3) varies depending on the location (both edges, the central portion, or the like) of the aforementioned fiber bundle block in the whole of the fiber bundle blocks (in FIG. 2, B1 to B3) of the sheet; however, the individual fiber bundles in each of the fiber bundle blocks (B1 to B3) travel in a state that the individual fiber bundles are lined up side by side in parallel to each other. On a flat roll (25) disposed parallel to the flat roll (21), the traveling pitch of all the fiber bundles of the sheet-like set of flame-retardant fiber bundles (12) comes to be the traveling pitch (P2) suitable for entering the inside of the precarbonization furnace. In this case, the maximum inclination angle of the fiber bundle blocks (in FIG. 2, the angle of B1) of the sheet-like set of fiber bundles when the fiber bundle block travels between the second roll pair (between the roll 23 and the roll 24), in relation to the plane perpendicular to the axes of the two rolls (22 and 25) constituting the first roll pair, is preferably set at smaller than 20°. Typically, the inclination angle is maximized in the fiber bundle block located at the edges of the sheet-like set of flame-retardant fiber bundles. There are two fiber bundle blocks located at the edges of the sheet-like set of flame-retardant fiber bundles; the inclination angles of these two fiber bundle blocks may be the same as each other or may be different from each other. When the inclination angles of the two fiber bundle blocks located at the edges are the same as each other, the same angle is the maximum inclination angle, and when the inclination angles of these two fiber bundle blocks are different from each other, the larger inclination angle of these two inclination angles is the maximum inclination angle.

Hereinafter, this maximum inclination angle is referred to as θ2. There are two fiber bundle blocks located at the edges, per one sheet-like set of fiber bundles, and in FIG. 1, the inclination angles of these fiber bundle blocks are the same as each other. Accordingly, in FIG. 1, θ2 is defined for the two fiber bundle blocks, located at both edges in the up-down direction in the plane of paper, among the five fiber bundle blocks, and thus θ2 exists at two positions. In FIG. 2, one of the two θ2s in FIG. 1 is shown; specifically, the inclination angle of the traveling direction of the fiber bundle block (B1) located at one of both edges of the sheet-like set of fiber bundles traveling between the angle-adjustable flat rolls (23 and 24) is shown.

When this inclination angle (θ2) is smaller than 20°, the occurrence of twisting can be easily prevented. The angle θ2 is more preferably smaller than 16°.

When the step (a) is performed, as shown in FIG. 2, by using the fiber bundles arranged at equal intervals in parallel to each other so as to form a single and the same plane, and successively the step (b) is performed, the inclination angles of all the fiber bundle blocks, in relation to the plane perpendicular to the axes of the two rolls (22, 25) constituting the first roll pair, in the sheet-like set of fiber bundles traveling between the second roll pair can be designed as follows. Specifically, the inclination angles of the fiber bundle blocks (for example, B1 in FIG. 2) located at both edges can be designed to be the largest, and the inclination angles of the fiber bundle blocks can be designed to be reduced as approaching to the center. In such a case, with regard to the inclination angles, in relation to the plane perpendicular to the axes of the two rolls (22, 25), of all the fiber bundle blocks traveling between the second roll pair, the largest angle of these inclination angles is preferably set at smaller than 20°, and more preferably set at smaller than 16°.

As described above, the two-stage traveling pitch alteration method composed of the step (a) and the step (b) can be used for the precarbonization-treated fiber bundles obtained from the precarbonization step as well as for the flame-retardant fiber bundles obtained from the flame-retarding step. Accordingly, for the sake of convenience, the θ1 and θ2 in the alteration of the traveling pitch of the flame-retardant fiber bundles obtained from the flame-retarding step using the roll group (4) are referred to as θ1-1 and θ2-1, respectively, and the θ1 and θ2 in the alteration of the traveling pitch of the precarbonization-treated fiber bundles obtained from the precarbonization step using the roll group (5) are referred to as θ1-2 and θ2-2, respectively.

The sheet-like set of flame-retardant fiber bundles (12) is altered, where necessary, with respect to the fiber bundle traveling pitch on the basis of the aforementioned two-stage traveling pitch alteration method (using the roll group (4) shown in FIG. 1), and then fed to the precarbonization furnace (2) from the fiber bundle inlet slot of the precarbonization furnace (2).

The atmosphere inside the precarbonization furnace (2) is an inert gas atmosphere. As the inert gas, nitrogen, argon or the like can be used; usually, nitrogen is used from the viewpoint of economic efficiency. The sheet-like set of flame-retardant fiber bundles (12) altered, where necessary, with respect to the traveling pitch, travels in the precarbonization furnace (2) while being precarbonization-treated, and then goes out from the precarbonization furnace (2) to be a sheet-like set of precarbonization-treated fiber bundles (13).

The highest treatment temperature in the heat treatment of the precarbonization step is set at 500 to 800° C. The heat treatment temperature inside the precarbonization furnace (2) is preferably 500° C. or higher and 800° C. or lower from the viewpoint of the strength development as carbon fibers. The precarbonization treatment time is preferably 0.6 minute or more and 3.0 minutes or less from the viewpoint of productivity and the strength development as carbon fibers.

Next, the fiber bundle traveling pitch of the sheet-like set of precarbonized fiber bundles (13) is altered, where necessary, in the same manner as in the case of the aforementioned sheet-like set of flame-retardant fiber bundles (12) by using, for example, the two-stage traveling pitch alteration method shown in FIGS. 1 to 4. In this case, the means to reduce the traveling pitch in the step (a) and the distance between the roll pair for the step (a) can be the same as in the case of the aforementioned fiber bundles (12). When the two-stage traveling pitch alteration method is adopted, the preferable angle ranges for the θ1-2 and θ2-2 in the steps (a) and (b) are the same as the angle ranges for the θ1-1 and θ2-1, respectively, in the aforementioned fiber bundle traveling pitch alteration of the sheet-like set of flame-retardant fiber bundles, and in place of the roll group 4 shown in FIG. 1, the roll group 5 having the same structure is used. Hereinafter, for the purpose of distinguishing between these two roll groups, the rolls (21 to 25) constituting the roll group (4) are referred to as the rolls (21-1 to 25-1) for the sake of convenience, and the rolls (21 to 25) constituting the roll group (5) are referred to as the rolls (21-2 to 25-2) for the sake of convenience.

The fiber bundle blocks in the steps (a) and (b) mean, in the case where the traveling pitch is altered with respect to the flame-retardant fiber bundles obtained from the flame-retarding step, fiber bundle blocks obtained when the flame-retardant fiber bundles obtained from the flame-retarding step are divided into two or more blocks, and mean, in the case where the traveling pitch is altered with respect to the precarbonization-treated fiber bundles obtained from precarbonization step, fiber bundle blocks obtained when the precarbonization-treated fiber bundles obtained from the precarbonization step are divided into two or more blocks. For example, in FIG. 1, the fiber bundle blocks in the steps (a) and (b) in the case where the traveling pitch of the flame-retardant fiber bundles obtained from the flame-retarding step is altered by using the roll group (4) mean the five fiber bundle blocks in the roll group (4). Similarly, in FIG. 1, the fiber bundle blocks in the steps (a) and (b) in the case where the traveling pitch of the precarbonization-treated fiber bundles obtained from the precarbonization step is altered by using the roll group (5) mean the five fiber bundle blocks in the roll group (5).

The fiber bundle traveling pitch is adjusted, in consideration of the productivity and the workability of the carbonization furnace, in such a way that when the traveling pitch of the fiber bundles in the flame-retarding step is represented by P1 and the traveling pitch of the fiber bundles in the carbonization step is represented by P3, P1 and P3 fall in the range of $0.4 \leq P3/P1 \leq 0.8$.

The sheet-like set of precarbonized fiber bundles (13) is altered, where necessary, with respect to the fiber bundle traveling pitch by the roll group (5) shown in FIG. 1 or the two grooved rolls shown in FIG. 5, and then fed to the carbonization furnace (3) from the fiber bundle inlet slot of the carbonization furnace (3).

The atmosphere inside the carbonization furnace (3) is an inert gas atmosphere. The sheet-like set of precarbonized fiber bundles (13) altered, where necessary, with respect to the traveling pitch, travels in the carbonization furnace (3) while being carbonization-treated, and then goes out from the carbonization furnace (3) to be a sheet-like set of carbonized fiber bundles (14).

The highest treatment temperature in the heat treatment of the carbonization step is set at 1000° C. or higher. The heat treatment temperature inside the carbonization furnace (3) is preferably 1200° C. or higher and 1800° C. or lower from the viewpoint of strength development. The carbonization treatment time is preferably 0.6 minute or more and 3.0 minutes or less from the viewpoint of productivity and strength development.

The sheet-like set of carbonized fiber bundles (14) completed in the heat treatment in the carbonization furnace (3) can be converted, where necessary, into graphitized fiber bundles by continuously passing the sheet-like set of carbonized fiber bundles (14) through a graphitization furnace filled with an inert gas atmosphere set at a temperature exceeding 2000° C. so as for the fiber bundles not to be oxidized.

The thus obtained carbonized or graphitized fiber bundles can be improved in affinity and adhesiveness between the carbon fiber or the graphite fiber and the matrix resin in composite materials by being subjected to electrolytic oxidation treatment in heretofore known electrolytes or oxidation treatment in vapor phase or liquid phase. Where necessary, by heretofore known methods, sizing agents can be imparted to the thus obtained carbonized or graphitized fiber bundles. Where necessary, heretofore known methods can be used, these heretofore known methods include, for example, installing a godet roll for controlling the tension of the fiber bundles under flame-retarding treatment.

The inventors studied the rational means for achieving the aforementioned objects, and consequently reached a second aspect and a third aspect of the present invention by discovering that the aforementioned objects can be achieved by altering the traveling pitch of the fiber bundles in one or both of the heat treatment section of the precarbonization furnace and the heat treatment section of the carbonization furnace. By the second and third aspects of the present invention, a method for producing carbon fiber bundles, excellent in productivity without impairing the quality in the production process of carbon fibers, can be provided.

In the flame-retarding step, in which the fiber bundles generate heat due to oxidation reaction, at the time of breakage, the broken fiber bundles may overlap with the adjacent fiber bundles to store heat and may take fire, and hence preferable is an arrangement in which the fiber bundles are arranged at equal intervals in the axis direction of a roll (for example, the roll 111 in FIG. 6), for the broken fiber bundles not to overlap with the adjacent fiber bundles.

On the other hand, in the precarbonization step and the carbonization step, in each of which treatment is performed in an inert gas atmosphere, even when broken fiber bundles overlap with the adjacent fiber bundles, the fiber bundles do not store heat and do not take fire, and hence the traveling pitch of the fiber bundles can be made narrower than in the flame-retarding step. However, in the precarbonization step, a lot of decomposed products may be generated at the stage of the conversion from the flame-retardant fibers to the carbonized fibers, and if the decomposed products remain in the fiber bundles, the quality may be affected, and hence the traveling pitch of the fiber bundles cannot be made extremely narrow.

On the other hands, in the carbonization step, the generation of decomposed products is small in amount, and accordingly, it has been revealed that even when the arrangement of the fiber bundles are altered during the carbonization treatment, or more specifically even when the traveling pitch is made further narrower than in the precarbonization step, none of the quality, the operation and the structure of the apparatus is affected.

The method for producing carbon fiber bundles according to the second or third aspects of the present invention includes the following steps: a flame-retarding step of converting a multitude of carbon fiber precursor fiber bundles into flame-retardant fiber bundles by heat treating the multitude of carbon fiber precursor fiber bundles in a flame-retarding oven in an oxidizing gas atmosphere at from 200 to 300° C. in a state that the multitude of carbon fiber precursor fiber bundles are lined up side by side; a precarbonization step of converting the flame-retardant fiber bundles into precarbonization-treated fiber bundles by heat-treating the flame-retardant fiber bundles in the precarbonization furnace in an inert gas atmosphere with the highest treatment temperature of from 500 to 800° C. in a state that the flame-retardant fiber bundles are lined up side by side; and a carbonization step of converting the precarbonization-treated fiber bundles into carbon fiber bundles by heat treating the precarbonization-treated fiber bundles in the carbonization furnace in an inert gas atmosphere with the highest treatment temperature of 1000° C. or higher in a state that the precarbonization-treated fiber bundles are lined up side by side.

In the method for producing carbon fiber bundles according to the second and third aspects of the present invention, as described above, the traveling pitch of the fiber bundles can be altered in the heat treatment section of the precarbonization furnace and/or in the heat treatment section of the carbonization furnace, and in this alteration, at least one of the following formulas (3) and (4) is satisfied. The heat treatment section of each furnace or oven means the section, in each furnace or oven, in which the heat treatment of the fiber bundles traveling in each furnace or oven is performed; in FIG. 6, the heat treatment sections 51*a* to 54*a* are shown.

The traveling pitch of the fiber bundles at the inlet of the heat treatment section of the precarbonization furnace is represented by P11, the traveling pitch of the fiber bundles at the outlet of the heat treatment section of the precarbonization furnace is represented by P12, the traveling pitch of the fiber bundles at the inlet of the heat treatment section of the carbonization furnace is represented by P13, and the traveling pitch of the fiber bundles at the outlet of the heat treatment section of the carbonization furnace is represented by P14.

$$0.40 \leq (P12/P11) \leq 0.90 \quad (3)$$

$$0.40 \leq (P14/P13) \leq 0.90 \quad (4)$$

Throughout these steps, the number of the fiber bundles remains unchanged.

Hereinafter, embodiments of the second and third aspects of the present invention are described in detail with reference to FIGS. 6 to 9.

However, the present invention is not limited to the embodiment.

First, a plurality of precursor fiber bundles (for example, about 100 to 200 bundles) are lined up side by side in a form of a sheet to prepare a sheet-like set of precursor fiber bundles, and then the sheet-like set of precursor fiber bundles is heat treated in the heat treatment section (51*a*) of a flame-retarding oven (51) to be flame-retarded, and thus flame-retardant fiber bundles are prepared. A multitude of fiber bundles lined up side by side form a plane, and such fiber bundles are referred to as a sheet-like set of fiber bundles.

Figure 6:
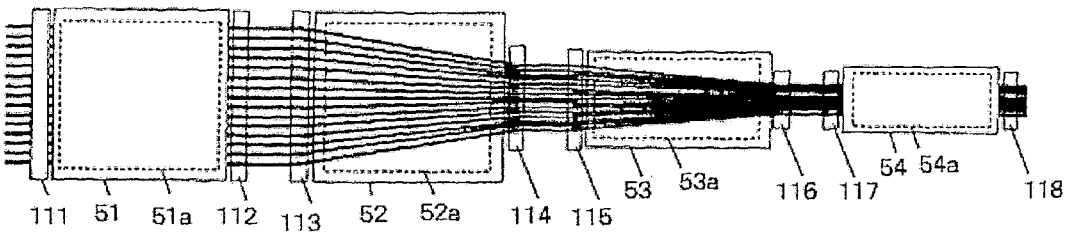
FIG. 6 is a schematic plane view of an apparatus capable of being used in an embodiment of a method for producing carbon fiber bundles according to a second aspect and a third aspect of the present invention.

Specifically, for example, as shown in FIG. 6, first, the sheet-like set of precursor fiber bundles is formed as follows: a plurality of precursor fiber bundles unraveled from a cheese (not shown) hung on a creel stand are arranged with a guide (not shown) at equal intervals in parallel to each other so as to form a single and the same plane. The guide is appropriately disposed in such a way that the equal interval state and the parallel state of the precursor fiber bundles are able to be maintained. Examples of a type of the guide include a grooved roll on the surface of which grooves are engraved at equal intervals and a guide in which pins are arranged at equal intervals.

As the plurality of precursor fiber bundles, precursor fiber bundles such as acrylic precursor fiber bundles and pitch based precursor fiber bundles can be used. The diameters, the number and the like of the precursor fiber bundles can be appropriately set according to the diameter and the productivity of the produced carbon fiber bundles.

The traveling position of each of the precursor fiber bundles in the sheet-like set of precursor fiber bundles can be controlled with the rolls (111, 112, 119) disposed outside the flame-retarding oven (51).

The traveling pitch of the precursor fiber bundles in the sheet-like set of precursor fiber bundles is the pitch obtained when the precursor fiber bundles are arranged at equal intervals, and can be measured, for example, on the roll (111) disposed on the inlet side of the flame-retarding oven (51) and on the roll (112) disposed on the outlet side of the flame-retarding oven (51). The traveling pitches of the fiber bundles on the inlet side roll (111) and the outlet side roll (112) are each represented by an average value of the measured values.

For example, when the rolls disposed on the inlet side and the outlet side of the flame-retarding oven (51) are grooved rolls, the pitches of the grooves of these rolls are the traveling pitches of the fiber bundles on the roll (111) on the inlet side and the roll (112) on the outlet side of the flame-retarding oven, respectively.

In FIG. 6, in the flame-retarding step, the traveling pitch of the fiber bundles is not altered, and hence the traveling pitch on the roll (111) on the inlet side and the traveling pitch on the roll (112) on the outlet side of the flame-retarding oven (51) are the same as each other.

From now on, the traveling pitch of the fiber bundles on the roll on the inlet side and the roll on the outlet side of each furnace or oven are measured in the same manner as described above.

The traveling pitch of the fiber bundles inside the flame-retarding oven, more specifically, inside the heat treatment section of the flame-retarding oven is preferably 4 mm or more and 20 mm or less from the viewpoint of productivity and prevention of heat storage, and preferably maintains a constant traveling pitch. For example, when the traveling pitch of the fiber bundles is 4 mm, it is meant that the center-to-center spacings (distances) between the adjacent fiber bundles in the width direction (in FIG. 6, the up-down direction in the plane of paper) are 4 mm. The traveling pitch of the fiber bundles inside the heat treatment section of the flame-retarding oven can be calculated by a geometrical calculation from the traveling pitches of the fiber bundles on the roll (111) on the inlet side and the roll (112) on the outlet side of the flame-retarding oven.

Next, the sheet-like set of precursor fiber bundles is fed to the flame-retarding oven (51). The sheet-like set of precursor fiber bundles travels while being subjected to flame-retarding treatment inside the heat treatment section (51*a*) of the flame-retarding oven filled with an oxidizing atmosphere, and then once goes to outside the flame-retarding oven (51). Next, the sheet-like set of precursor fiber bundles is turned over by the first turn-over roll of the turn-over roll group (119) provided outside the flame-retarding oven (51). Then, the sheet-like set of precursor fiber bundles again passes through the heat treatment section (51*a*) of the flame-retarding oven to be subjected to flame-retarding treatment. Subsequently, the sheet-like set of precursor fiber bundles is repeatedly subjected to flame-retarding treatment between the turn-over rolls of the turn-over roll group (119). In this way, the sheet-like set of flame-retardant fiber bundles is obtained. The oxidizing gas atmosphere is not particularly limited as far as the atmosphere is oxidative, and air is usually used as the oxidizing gas atmosphere from the viewpoint of economic efficiency.

Figure 7:
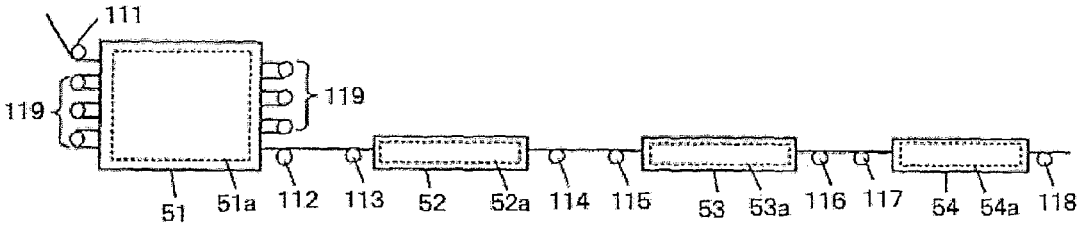
FIG. 7 is a schematic side view of an apparatus capable of being used in an embodiment of a method for producing carbon fiber bundles according to the second aspect and the third aspect of the present invention.

In FIGS. 6 and 7, one flame-retarding oven is illustrated; however, in the present invention, preferable is a method in which several flame-retarding ovens are continuously disposed, and the treatment temperatures of the heat treatment sections of these flame-retarding ovens are gradually increased according to the progress of the flame-retarding treatment of the precursor fiber bundles. In this case, the temperatures of the heat treatment sections of these flame-retarding ovens are set at 200° C. or higher and 300° C. or lower, from the viewpoint of prevention of heat storage. The flame-retarding treatment time is preferably 20 minutes or more and 120 minutes or less from the viewpoint of productivity and prevention of heat storage. The conveying speed is preferably 3 m/min or more and 20 m/min or less from the viewpoint of productivity.

When a plurality of flame-retarding ovens (n flame-retarding ovens) are continuously disposed, the roll on the inlet side of the flame-retarding oven means the roll on the inlet side of the first flame-retarding oven through which the sheet-like set of precursor fiber bundles initially passes, and the roll on the outlet side of the flame-retarding oven means the roll on the outlet side of the n-th flame-retarding oven through which the sheet-like set of precursor fiber bundles finally passes.

Figure 9:
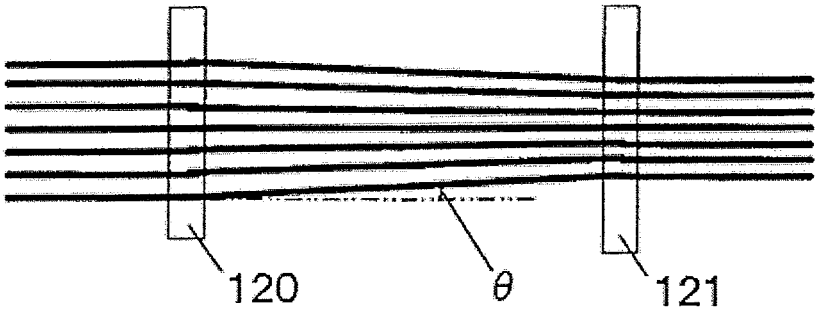
FIG. 9 is a view for illustrating an embodiment of a method for altering the traveling pitch of fiber bundles.

In the production method according to the present invention, by using two rolls (120 and 121) parallel to each other as shown in FIG. 9, the traveling pitch of the fiber bundles can be altered in each of the furnaces and the oven (in the flame-retarding oven(s), preferably the traveling pitch of the fiber bundles is not altered but is maintained to be constant). In this case, θ represents the maximum inclination angle among the inclination angles of the multitude of fiber bundles, lined up side by side, traveling between these two rolls, in relation to the plane perpendicular to the axis directions of these two rolls.

Typically, the maximum inclination angle is the inclination angle of the fiber bundle located at the edge of the multitude of the fiber bundles lined up side by side, and the inclination angle of the fiber bundle is reduced as approaching to the center of the lined-up fiber bundles. As shown in FIG. 9, the number of fiber bundles located at the edges of the multitude of the fiber bundles is two, and the inclination angles of these two fiber bundles may be the same as each other or may be different from each other. When the inclination angles of the two fiber bundles located at both edges are the same as each other, the same angle is the maximum inclination angle θ, and when the inclination angles of these two fiber bundles are different from each other, the larger inclination angle of these two inclination angles is the maximum inclination angle θ. FIG. 9 shows a case where the inclination angles of the two fiber bundles located at both edges are the same as each other, and shows one of the maximum inclination angles θ.

Hereinafter, the maximum inclination angle θ in the pre-carbonization step is referred to as θ11 and the maximum inclination angle θ in the carbonization step is referred to as θ13.

In order to alter the traveling pitch of the sheet-like set of flame-retardant fiber bundles subjected to the flame-retarding treatment, the roll (113) on the inlet side of the precarbonization furnace (52) and the roll (114) on the outlet side of the precarbonization furnace (52), parallel to each other, respectively disposed on the front side and the back side (the inlet side and the outlet side) of the precarbonization furnace (52) can be used as the two rolls (20 and 21). Accordingly, the alteration of the traveling pitch of the fiber bundles can be performed inside the precarbonization furnace (2); in this case, the maximum inclination angle θ11 is preferably adjusted to fall within the range of $0.1° < \theta 11 < 3.0°$, and more preferably within the range of $0.3° < \theta 11 < 2.5°$.

When the maximum inclination angle is larger than 0.1°, the increase of the distance between the roll (113) and the roll (114) can be easily prevented, and the increase of the length of the precarbonization furnace can be easily prevented. When the maximum inclination angle is smaller than 3.0°, the occurrence of twisting can be easily prevented.

The aforementioned two rolls (113 and 114) can each be disposed perpendicular to the traveling direction of the multitude of the flame-retardant fiber bundles lined up side by side, obtained from the flame-retarding step and parallel to the plane formed by these fiber bundles.

The rolls (111 to 118) usable for the alteration of the traveling pitch are typically disposed outside each of the furnaces and the oven as shown in FIG. 6, and alternatively may be disposed inside each of the furnaces and the oven and outside the heat treatment sections of each of the furnaces and the oven.

In the alteration of the traveling pitch of the fiber bundles, in consideration of the productivity of the precarbonization furnace and the effect of the decomposed products on the quality, when the traveling pitch of the fiber bundles at the inlet of the heat treatment section (52*a*) of the precarbonization furnace is represented by P11 and the traveling pitch of the fiber bundles at the outlet of the heat treatment section (52*a*) of the precarbonization furnace is represented by P12, P11 and P12 are adjusted to satisfy the range of $0.40 \leq (P12/P11) \leq 0.90$ and preferably the range of $0.50 \leq (P12/P11) \leq 0.85$.

Figure 8:
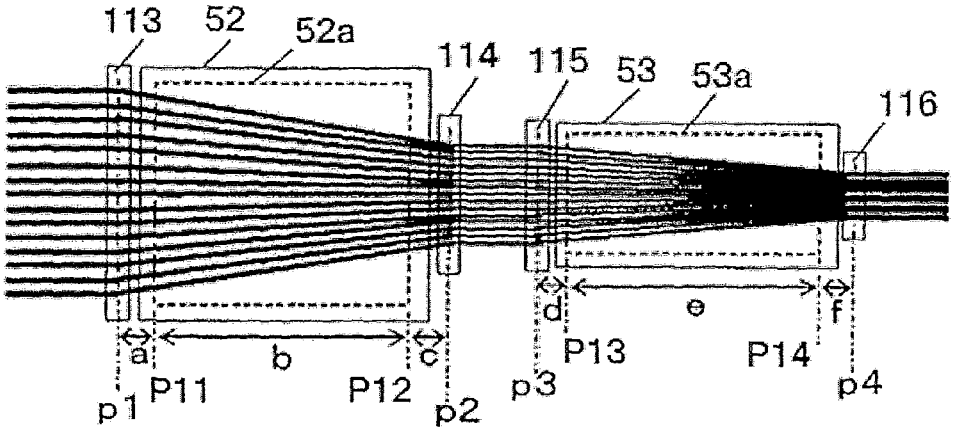
FIG. 8 is a view for illustrating a method for calculating the traveling pitches of the fiber bundles at the inlet and the outlet of the heat treatment section of the precarbonization furnace and the heat treatment section of the carbonization furnace according to the second aspect and the third aspect of the present invention.

As shown in FIG. 8, the traveling pitches (P11 and P12) of the fiber bundles at the inlet and the outlet of the heat treatment section of the precarbonization furnace can be calculated from the traveling pitches (p1 and p2), measured with the aforementioned method, of the fiber bundles on the rolls (113 and 114) disposed respectively on the inlet side and the outlet side of the precarbonization furnace, by the geometrical calculations using the following formulas (5) and (6):

$$P11 = p1 - \{a \times (p1 - p2)/(a + b + c)\} \quad (5)$$

$$P12 = p1 - \{(a + b) \times (p1 - p2)/(a + b + c)\} \quad (6)$$

The symbols in formulas (5) and (6) are as follows:

P11: The traveling pitch of the fiber bundles at the inlet of the heat treatment section of the precarbonization furnace P12: The traveling pitch of the fiber bundles at the outlet of the heat treatment section of the precarbonization furnace p1: The traveling pitch of the fiber bundles on the roll disposed on the inlet side of the precarbonization furnace p2: The traveling pitch of the fiber bundles on the roll disposed on the outlet side of the precarbonization furnace a: The distance from a position (the measurement position of p1) on the roll disposed on the inlet side of the precarbonization furnace to the inlet of the heat treatment section of the precarbonization furnace b: The distance from the inlet to the outlet of the heat treatment section of the precarbonization furnace c: The distance from the outlet of the heat treatment section of the precarbonization furnace to a position (the measurement position of p2) on the roll disposed on the outlet side of the precarbonization furnace As the method for altering the traveling pitch of the fiber bundles, there can be used heretofore known techniques such as a method in which grooved rolls are used as the roll (113) on the inlet side of the precarbonization furnace and the roll (114) on the outlet side of the precarbonization furnace and a method in which a comb guide and a flat roll are combined.

The sheet-like set of flame-retardant fiber bundles is rearranged, where necessary, with the roll (113) on the inlet side of the precarbonization furnace, and then is fed to the precarbonization furnace (52) from the fiber bundle inlet slot of the precarbonization furnace (52). The atmosphere inside the precarbonization furnace (52) is an inert gas atmosphere. As the inert gas, nitrogen, argon or the like can be used; usually, nitrogen is used from the viewpoint of economic efficiency. The sheet-like set of flame-retardant fiber bundles travels in the heat treatment section (52*a*) of the precarbonization furnace while being subjected to precarbonization treatment, and where necessary, while the traveling pitch is being narrowed, and then goes out from the precarbonization furnace (52) to be the sheet-like set of precarbonized fiber bundles rearranged in a state that the traveling pitch has been altered, where necessary, with the roll (114) on the outlet side of the precarbonization furnace.

The heat treatment section (52*a*) of the precarbonization furnace can be composed of a plurality of temperature-adjustable blocks (sections). The temperature of the heat treatment section (52*a*) is preferably gradually increased from a temperature higher than the highest treatment temperature in the flame-retarding oven; the highest treatment temperature of the heat treatment section (52*a*) is set at 500° C. or higher and 800° C. or lower from the viewpoint of the strength development as carbon fiber. The precarbonization treatment time is preferably 0.6 minute or more and 3 minutes or less from the viewpoint of productivity and the strength development as carbon fiber.

Next, by using, as the two rolls (120 and 121) shown in FIG. 9, the roll (115) on the inlet side of the carbonization furnace (53) and the roll (116) on the outlet side of the carbonization furnace (53), parallel to each other, respectively disposed on the front side and the back side (the inlet side and the outlet side) of the carbonization furnace (53), the alteration of the traveling pitch of the sheet-like set of precarbonized fiber bundles can be performed in the carbonization furnace (53). The two rolls (115 and 116) can each be disposed perpendicular to the traveling direction of the multitude of the precarbonized fiber bundles lined up side by side, obtained from the precarbonization step and parallel to the plane formed by these fiber bundles.

In the alteration of the traveling pitch of the fiber bundles, in consideration of the productivity of the carbonization furnace and the effect of the decomposed products on the quality, when the traveling pitch of the fiber bundles at the inlet of the heat treatment section (53*a*) of the carbonization furnace is represented by P13 and the traveling pitch of the fiber bundles at the outlet of the heat treatment section (53*a*) of the carbonization furnace is represented by P14, P13 and P14 are adjusted to satisfy the range of $0.40 \leq (P14/P13) \leq 0.90$ and more preferably the range of $0.50\ (P14/P13) \leq 0.85$.

The traveling pitches (P13 and P14) of the fiber bundles at the inlet and outlet of the heat treatment section (53*a*) of the carbonization furnace can be calculated by using the same calculation formulas as for the aforementioned P11 and P12. In this case, as shown in FIG. 8, p1, p2 and a to c correspond to p3, p4 and d to f, respectively.

The maximum inclination angle θ13 among the inclination angles of the multitude of the fiber bundles, lined up side by side, traveling between the two rolls (115 and 116), in relation to the plane perpendicular to the axis directions of the two rolls (115 and 116) is preferably adjusted to fall within the range of $0.1° < \theta 13 < 3.0°$. When the maximum inclination angle is larger than 0.1°, the increase of the distance between the roll (115) and the roll (116) can be easily prevented, and the increase of the length of the carbonization furnace can be easily prevented. When the maximum inclination angle is smaller than 3.0°, the occurrence of twisting can be easily prevented. Moreover, the maximum inclination angle θ13 is further preferably adjusted to fall within the range of $0.3° < \theta 13 < 2.5°$.

As the method for altering the traveling pitch of the fiber bundles traveling in the carbonization furnace, the same method as the aforementioned method applied in the precarbonization furnace can be used.

The sheet-like set of precarbonized fiber bundles is rearranged, where necessary, with the roll (115) on the inlet side of the carbonization furnace, and then is fed to the carbonization furnace (53) from the fiber bundle inlet slot of the carbonization furnace (53). The atmosphere inside the carbonization furnace (53) is an inert gas atmosphere. The sheet-like set of precarbonized fiber bundles travels in the heat treatment section (53*a*) of the carbonization furnace while being subjected to carbonization treatment, and where necessary, while the traveling pitch is being narrowed, and then goes out from the carbonization furnace (53) to be the sheet-like set of carbonized fiber bundles rearranged in a state that the traveling pitch has been altered, where necessary, with the roll (116) on the outlet side of the carbonization furnace.

The heat treatment section (53*a*) of the carbonization furnace can be composed of a plurality of temperature-adjustable blocks. The temperature of the heat treatment section (53*a*) is preferably gradually increased from a temperature higher than the highest treatment temperature in the precarbonization furnace; the highest treatment temperature of the heat treatment section (53*a*) is set at 1000° C. or higher. The temperature in the heat treatment section (53*a*) of the carbonization furnace is preferably 1200° C. or higher and 1800° C. or lower from the viewpoint of strength development. The carbonization treatment time is preferably 0.6 minute or more and 3 minutes or less from the viewpoint of productivity and strength development.

The sheet-like set of carbonized fiber bundles completed in the heat treatment in the carbonization furnace (53) may be converted, where necessary, into graphitized fiber bundles by continuously passing the sheet-like set of carbonized fiber bundles through a graphitization furnace (54), more specifically the heat treatment section (54*a*) of the graphitization furnace, filled with an inert gas atmosphere so as for the fiber bundles not to be oxidized, set at a temperature exceeding 2000° C.

The traveling position of each of the carbonized fiber bundles in the sheet-like set of carbonized fiber bundles can be controlled with the rolls (117 and 118) disposed outside the graphitization furnace (54). In FIG. 6, the traveling pitch of the fiber bundles is not altered in the graphitization step, and hence the traveling pitch on the roll (117) on the inlet side of the graphitization furnace (54) and the traveling pitch on the roll (118) on the outlet side of the graphitization furnace (54) are the same as each other.

The thus obtained carbonized or graphitized fiber bundles can be improved in the affinity and the adhesiveness between the carbon fiber or the graphite fiber and the matrix resin in a composite material by being subjected to electrolytic oxidation treatment in heretofore known electrolytes or oxidation treatment in vapor phase or liquid phase. Where necessary, by heretofore known methods, sizing agents can be imparted to the thus obtained carbonized or graphitized fiber bundles. Where necessary, heretofore known methods including, for example, installing a godet roll for controlling the tension of the fiber bundles under heat treatment can be used.

EXAMPLES

Hereinafter, the first aspect of the present invention is more specifically described on the basis of Examples; however, the method for producing carbon fiber bundles, according to the first aspect of the present invention, is not limited to these Examples.

Example 1

In Example 1, carbon fibers were produced by using an apparatus having the structure shown in FIG. 1. However, the number of fiber bundle blocks in Example 1 is different from the number of fiber bundle blocks in FIG. 1. In each of Examples 1 to 12 and Comparative Examples 1 to 3, inclination angles of fiber bundles located at both edges in each of the fiber bundle blocks traveling between a roll (21) and a roll (22) shown in FIGS. 2 to 4, in relation to a plane perpendicular to the axes of these two rolls were designed to be the same angle, and this same angle was the maximum inclination angle (θ1). Additionally, in each of Examples 1 to 12 and Comparative Examples 1 to 3, inclination angles of fiber bundle blocks located at both edges in sheet-like set of fiber bundles traveling between angle-adjustable rolls (23 and 24), in relation to a plane perpendicular to the axes of a roll (22) and a roll (25) were designed to be the same angle, and this same angle was the maximum inclination angle (82).

Flame-Retarding Step

A sheet-like set of precursor fiber bundles (11) was prepared by arranging 100 acrylic precursor fiber bundles having a single yarn fineness of 0.8 dTex and a filament number of 24,000 at a pitch of 10 mm (P1: 10 mm) at equal intervals on a grooved guide roll. The sheet-like set of precursor fiber bundles (11) was repeatedly passed through a flame-retarding oven (1) with a roll group disposed on the left and right sides of the flame-retarding oven (1) in which hot air at from 230 to 270° C. was circulated, thus a flame-retarding treatment for 50 minutes was performed, and the sheet-like set of precursor fiber bundles (11) was converted into a sheet-like set of flame-retardant fiber bundles (12).

Traveling Pitch Alteration Step-1

(Step (a))

The 100 fiber bundles going out from the flame-retarding oven (1) and traveling as lined up side by side in parallel to each other were divided into eight blocks; by using two rolls (a flat roll (21-1) and a grooved roll (22-1)) disposed parallel to each other, a fiber bundle traveling pitch in each of the eight fiber bundle blocks was altered to 9 mm. The grooved roll (22-1) had grooves engraved at equal intervals of a pitch of 9 mm, and the flat roll (21-1) and the grooved roll (22-1) were disposed at a distance of 1 m from each other. In this case, inclination angles (θ1-1) of fiber bundles located at both edges in each of the fiber bundle blocks traveling between the flat roll (21-1) and the grooved roll (22-1), in relation to a plane perpendicular to the axes of these two rolls, were each 0.4°.

(Step (b))

In the eight fiber bundle blocks in which the fiber bundle traveling pitch in each of the fiber bundle blocks had been altered to 9 mm, spacings between adjacent fiber bundle blocks were decreased with roll arrangement shown in FIGS. 2 and 3, and thus the traveling pitch was altered to be 9 mm for all the fiber bundles. More specifically, the adjacent fiber bundle blocks were brought closer to each other by using a plurality of angle-adjustable second roll pairs (flat rolls (23-1) and flat rolls (24-1)) disposed between the first roll pair (the grooved roll (22-1) and a flat roll (25-1)). The two rolls constituting the first roll pair were disposed parallel to each other, and the two rolls constituting each of the second roll pairs were also disposed parallel to each other. In each of the second roll pairs, the flat roll (23-1) and the flat roll (24-1) were disposed at a distance of 1 m from each other.

In this case, inclination angles (θ2-1) of fiber bundle blocks located at both edges of the sheet-like set of fiber bundles, which had been divided into eight fiber bundle blocks, traveling between the angle-adjustable flat rolls (23-1 and 24-1), in relation to a plane perpendicular to the axes of the grooved roll (22-1) and the flat roll (25-1), were each 3.0°.

By the above-described traveling pitch alteration step (step (a) and step (b)), 100 fiber bundles traveling as lined up side by side in parallel to each other with the traveling pitch of the fiber bundles altered from 10 mm (P1) to 9 mm (P2) were obtained, namely, a sheet-like set of flame-retardant fiber bundles (12) having a traveling pitch of 9 mm was obtained.

Precarbonization Step

Next, the sheet-like set of flame-retardant fiber bundles (12) having a traveling pitch of 9 mm was introduced into a precarbonization furnace (2), in which a substantial heating section was filled with nitrogen and had a temperature distribution of 300 to 600° C., to be heat treated for 2 minutes and thus converted into a sheet-like set of precarbonized fiber bundles (13).

Traveling Pitch Alteration Step-2

The traveling pitch of the fiber bundles of the sheet-like set of precarbonized fiber bundles (13) going out from the precarbonization furnace (2) and traveling as lined up side by side in parallel to each other was altered from 9 mm (P2) to 5 mm (P3) by using the same method as the aforementioned method for altering the traveling pitch of the fiber bundles.

In this case, the aforementioned steps (a) and (b) were performed, by using a roll group (5) consisting of rolls (21-2 to 25-2) being the same in structure as the rolls (21-1 to 25-1), in place of a roll group (4) consisting of the rolls (21-1 to 25-1), to alter the traveling pitch of the fiber bundles. Here, the flat roll (21-2) and the grooved roll (22-2) were disposed at a distance of 1 m from each other. Inclination angles (θ1-2) of fiber bundles located at both edges in each of the fiber bundle blocks traveling between the flat roll (21-2) and the grooved roll (22-2), in relation to a plane perpendicular to the axes of these two rolls, were each 1.4°. In each pairs of the flat rolls (23-2) and the flat rolls (24-2), these two rolls were disposed at a distance of 1 m from each other. In this case, a inclination angles (θ2-2) of fiber bundle blocks located at both edges of the sheet-like set of fiber bundles, which consisted of eight fiber bundle blocks, traveling between the angle-adjustable flat rolls (23-2 and 24-2), in relation to the plane perpendicular to the axes of the grooved roll (22-2) and the flat roll (25-2), were each 11°.

Thus, 100 fiber bundles traveling as lined up side by side in parallel to each other with the traveling pitch (P3) of the fiber bundles of 5 mm were obtained, namely, a sheet-like set of precarbonized fiber bundles (13) having a traveling pitch of 5 mm was obtained.

Carbonization Step

Next, the sheet-like set of precarbonized fiber bundles (13) having a traveling pitch of the fiber bundles altered to 5 mm (P3) was introduced into a carbonization furnace (3), in which a substantial heating section was filled with nitrogen and had a temperature distribution of 1000 to 1500° C., to be heat treated for 2 minutes and thus converted into 100 fiber bundles traveling as lined up side by side in parallel to each other, namely, the sheet-like set of precarbonized fiber bundles (13) was converted into a sheet-like set of carbonized fiber bundles (14). Further, the sheet-like set of carbonized fiber bundles (14) was subjected to an electrolytic oxidation surface treatment and a sizing treatment to be converted into carbon fiber bundles. The carbon fiber bundles were satisfactory in quality.

The productivity and the quality of the carbon fiber bundles shown in Table 1 were evaluated on the basis of the following standards.

Productivity

○: P3/P1≤0.8, namely, a case where width of the carbonization furnace (3) is able to be reduced by 20% or more in relation to width of the flame-retarding oven (1).

x: 0.8<P3/P1, namely, a case where the width of the carbonization furnace (3) is able to be reduced only by less than 20% in relation to the width of the flame-retarding oven (1).

Quality

○: The quality of carbon fibers is excellent and absolutely free from problems.

Δ: The quality of carbon fibers is somewhat low, but free from problems.

x: The quality of carbon fibers causes problems.

Example 2

The number of the fiber bundle blocks in the traveling pitch alteration steps-1 and -2 was changed to 5, θ1-1 was changed to 0.6° in every corresponding inclination angle, and θ1-2 was changed to 2.3° in every corresponding inclination angle. Carbon fiber bundles were prepared in the same manner as in Example 1 except for these changes. The obtained carbon fiber bundles were satisfactory in quality.

Example 3

The distance between the flat roll (23-1) and the flat roll (24-1) was changed to 0.75 m in every corresponding roll pair and θ2-1 was changed to 4° in every corresponding inclination angle. Additionally, the distance between the flat roll (23-2) and the flat roll (24-2) was changed to 0.75 m in every corresponding roll pair and θ2-2 was changed to 15° in every corresponding inclination angle. Carbon fiber bundles were prepared in the same manner as in Example 1 except for these changes. The obtained carbon fiber bundles were satisfactory in quality.

Example 4

The number of the fiber bundle blocks in the traveling pitch alteration steps-1 and -2 was changed to 4, and θ1-1 was changed to 0.7° in every corresponding inclination angle. The distance between the flat roll (23-1) and the flat roll (24-1) was changed to 0.5 m in every corresponding roll pair, and θ2-1 was changed to 6° in every corresponding inclination angle. The traveling pitch, after alteration, of the sheet-like set of precarbonized fiber bundles (13) going out from the precarbonization furnace (2) and traveling as lined up side by side in parallel to each other, namely, the traveling pitch (P3) in the carbonization step was changed to 7 mm. Further, the distance between the flat roll (23-2) and the flat roll (24-2) was changed to 0.5 m in every corresponding roll pair. Carbon fiber bundles were prepared in the same manner as in Example 1 except for these changes. The obtained carbon fiber bundles were satisfactory in quality.

Example 5

The number of the fiber bundle blocks in the traveling pitch alteration step-1 was changed to 5, and the traveling pitch, after alteration, of the sheet-like set of flame-retardant fiber bundles (12), namely, the traveling pitch (P2) of the fiber bundles in the precarbonization step was changed to 8 mm. Additionally, θ1-1 was changed to 1.1° in every corresponding inclination angle, and θ2-1 was changed to 6° in every corresponding inclination angle. Further, the traveling pitch (P3) of the fiber bundles in the carbonization step was changed to 8 mm; in Example 5, the traveling pitch alteration step-2 was not performed, and the sheet-like set of precarbonized fiber bundles (13) obtained from the precarbonization step was fed to the carbonization step with the traveling pitch remaining unaltered. Carbon fiber bundles were prepared in the same manner as in Example 1 except for these changes. The obtained carbon fiber bundles were satisfactory in quality.

Example 6

The traveling pitch (P2) of the fiber bundles in the precarbonization step was changed to 10 mm; in Example 6, the traveling pitch alteration step-1 was not performed, and the sheet-like set of flame-retardant fiber bundles (12) obtained from the flame-retarding step was fed to the precarbonization step with the traveling pitch remaining unaltered. In the traveling pitch alteration step-2, the number of the blocks dividing the sheet-like set of precarbonized fiber bundles (13) going out from the precarbonization furnace (2) and traveling as lined up side by side in parallel to each other was changed to 5, θ1-2 was changed to 1.7° in every corresponding inclination angle, and θ2-2 was changed to 9° in every corresponding inclination angle. Further, the traveling pitch (P3) of the fiber bundles in the carbonization step was changed to 7 mm. Carbon fiber bundles were prepared in the same manner as in Example 1 except for these changes. The obtained carbon fiber bundles were satisfactory in quality.

Comparative Example 1

The traveling pitch, after alteration, of the sheet-like set of flame-retardant fiber bundles (12), namely, the traveling pitch (P2) of the fiber bundles in the precarbonization step was changed to 7 mm. Additionally, θ1-1 was changed to 1.1° in every corresponding inclination angle, and θ2-1 was changed to 9° in every corresponding inclination angle. Further, the traveling pitch (P3) of the fiber bundles in the carbonization step was changed to 7 mm; in Comparative Example 1, the traveling pitch alteration step-2 was not performed, and the sheet-like set of precarbonized fiber bundles (13) obtained from the precarbonization step was fed to the carbonization step with the traveling pitch remaining unaltered. Carbon fiber bundles were prepared in the same manner as in Example 1 except for these changes. Under the conditions of Comparative Example 1, when the traveling pitch of the fiber bundles of the sheet-like set of flame-retardant fiber bundles (12) was altered (at the time of the traveling pitch alteration step-1), single yarn breakage occurred on the grooved roll (22-1) and no carbon fiber bundles satisfactory in quality were able to be obtained.

Comparative Example 2

The traveling pitch, after alteration, of the sheet-like set of precarbonized fiber bundles (13), namely, the traveling pitch (P3) of the fiber bundles in the carbonization step was changed to 3 mm. Additionally, θ1-2 was changed to 2.1° in every corresponding inclination angle, and θ2-2 was changed to 17° in every corresponding inclination angle. Carbon fiber bundles were prepared in the same manner as in Example 1 except for these changes. Under the conditions of Comparative Example 2, when the traveling pitch of the fiber bundles of the sheet-like set of precarbonized fiber bundles (13) was altered (at the time of the traveling pitch alteration step-2), single yarn breakage occurred on the grooved roll (22-2) and no carbon fiber bundles satisfactory in quality were able to be obtained.

Comparative Example 3

Without altering the traveling pitch of the fiber bundles (without performing the traveling pitch alteration steps-1 and -2, the sheet-like set of flame-retardant fiber bundles (12) obtained from the flame-retarding step was fed to the precarbonization step with the traveling pitch remaining unaltered, and the sheet-like set of precarbonized fiber bundles (13) obtained from the precarbonization step was fed to the carbonization step with the traveling pitch remaining unaltered), the precarbonization furnace and the carbonization furnace which had the same width as that of the flame-retarding oven were used. Carbon fiber bundles were produced under the same conditions as in Example 1 except for these changes. Under the conditions of Comparative Example 3, carbon fiber bundles satisfactory in quality were obtained; however, carbonization was performed with a carbonization furnace having a width wider than necessary, and hence the productivity was degraded as compared to Examples.

Example 7

Carbon fiber bundles were prepared in the same manner as in Example 1 except that the following traveling pitch alteration steps-3 and -4 were performed respectively in place of the traveling pitch alteration steps-1 and -2.

Traveling Pitch Alteration Step-3

The traveling pitch (P1: 10 mm) of the 100 fiber bundles going out from the flame-retarding oven (1) and traveling as lined up side by side in parallel to each other was altered to 9 mm (P2) with the two grooved rolls (two grooved rolls having grooves engraved at equal intervals of a pitch of 10 mm and 9 mm, respectively) as shown in FIG. 5. The distance between these two grooved rolls was set at 1 m. Thus, 100 fiber bundles traveling as lined up side by side in parallel to each other, having a traveling pitch of 9 mm (a sheet-like set of flame-retardant fiber bundles having a traveling pitch of 9 mm) were obtained.

Traveling Pitch Alteration Step-4

The traveling pitch of the fiber bundles of the sheet-like set of precarbonized fiber bundles going out from the precarbonization furnace (2) and traveling as lined up side by side in parallel to each other was altered from 9 mm (P2) to 5 mm (P3) with the same method as the aforementioned traveling pitch alteration method using two grooved rolls. In this case, the distance between the two grooved rolls (two grooved rolls having grooves engraved at equal intervals of a pitch of 9 mm and 5 mm, respectively) was set at 4 m. Thus, 100 fiber bundles traveling as lined up side by side in parallel to each other, having a traveling pitch (P3) of the fiber bundles of 5 mm (a sheet-like set of precarbonized fiber bundles having a traveling pitch of 5 mm) were obtained.

Under the conditions of Example 7, at the time of the alteration of the traveling pitch of the fiber bundles, somewhat twisting occurs on the grooved roll (the grooved roll denoted by reference numeral 27 as shown in FIG. 5), and hence the quality of the carbon fiber bundles was somewhat degraded as compared to Examples 1 to 6, but the fiber bundles were satisfactory in quality as compared to Comparative Examples.

Example 8

The number of the fiber bundle blocks in the traveling pitch alteration steps-1 and -2 was changed to 3, and θ1-1 was changed to 1.0° in every corresponding inclination angle. Additionally, θ1-2 was changed to 3.8° in every corresponding inclination angle. Carbon fiber bundles were prepared in the same manner as in Example 1 except for these changes. Under the conditions of Example 8, at the time of the alteration of the traveling pitch of the fiber bundles (at the time of the traveling pitch alteration step-2), somewhat twisting occurs on the grooved roll (22-2), and hence the quality of the carbon fiber bundles was somewhat degraded as compared to Examples 1 to 6, but the fiber bundles were satisfactory in quality as compared to Comparative Examples.

Example 9

The distance between the flat roll (23-1) and the flat roll (24-1) was changed to 0.5 m in every corresponding roll pair, and θ2-1 was changed to 6° in every corresponding inclination angle. Additionally, the distance between the flat roll (23-2) and the flat roll (24-2) was changed to 0.5 m in every corresponding roll pair, and θ2-2 was changed to 22° in every corresponding inclination angle. Carbon fiber bundles were prepared in the same manner as in Example 1 except for these changes. Under the conditions of Example 9, at the time of the alteration of the traveling pitch of the fiber bundles (during the traveling pitch alteration step-2), somewhat twisting occurs on the flat rolls (23-2 and 24-2), and hence the quality of the carbon fiber bundles was somewhat degraded as compared to Examples 1 to 6, but the fiber bundles were satisfactory in quality as compared to Comparative Examples.

Example 10

The number of the acrylic precursor fiber bundles was changed to 600. In the traveling pitch alteration step-1, the distance between the two rolls (the flat roll (21-1) and the grooved roll (22-1)) disposed parallel to each other was changed to 9 m, θ1-1 was changed to 0.2°, the distance between the flat roll (23-1) and the flat roll (24-1) was 1 m, namely the same as in Example 1, and θ2-1 was changed to 17°. Further, in the traveling pitch alteration step-2, the distance between the flat roll (21-2) and the grooved roll (22-2) was changed to 9 m, and θ1-2 was changed to 1.0°, the distance between the flat roll (23-2) and the flat roll (24-2) was changed to 5 m, and θ2-2 was changed to 13°. Carbon fiber bundles were prepared in the same manner as in Example 1 except for these changes. The obtained carbon fiber bundles were satisfactory in quality.

Example 11

The number of the acrylic precursor fiber bundles was changed to 600. In the traveling pitch alteration step-1, the distance between the two rolls (the flat roll (21-1) and the grooved roll (22-1)) disposed parallel to each other was changed to 12 m, θ1-1 was changed to 0.2°, the distance between the flat roll (23-1) and the flat roll (24-1) was 1 m, namely the same as in Example 1, and θ2-1 was changed to 17°. Further, in the traveling pitch alteration step-2, the distance between the flat roll (21-2) and the grooved roll (22-2) was changed to 12 m, and θ1-2 was changed to 0.7°, the distance between the flat roll (23-2) and the flat roll (24-2) was changed to 5 m, and θ2-2 was changed to 13°. Carbon fiber bundles were prepared in the same manner as in Example 1 except for these changes. The obtained carbon fiber bundles were satisfactory in quality.

Example 12

The number of the acrylic precursor fiber bundles was changed to 600. In the traveling pitch alteration step-1, the distance between the two rolls (the flat roll (21-1) and the grooved roll (22-1)) disposed parallel to each other was changed to 15 m, θ1-1 was changed to 0.1°, the distance between the flat roll (23-1) and the flat roll (24-1) was 1 m, namely the same as in Example 1, and θ2-1 was changed to 17°. Further, in the traveling pitch alteration step-2, the distance between the flat roll (21-2) and the grooved roll (22-2) was changed to 15 m, and θ1-2 was changed to 0.6°, the distance between the flat roll (23-2) and the flat roll (24-2) was changed to 5 m, and θ2-2 was changed to 13°. Carbon fiber bundles were prepared in the same manner as in Example 1 except for these changes. The obtained carbon fiber bundles were satisfactory in quality.

The evaluation results of aforementioned Examples and Comparative Examples are shown in Table 1.

TABLE 1

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Traveling pitch P1 (mm) in flame-retarding oven | 10 | 10 | 10 | 10 | 10 | 10 | 10 | 10 | 10 |
| Traveling pitch P2 (mm) in precarbonization furnace | 9 | 9 | 9 | 9 | 8 | 10 | 7 | 9 | 10 |
| Traveling pitch P3 (mm) in carbonization furnace | 5 | 5 | 5 | 7 | 8 | 7 | 7 | 3 | 10 |
| P2/P1 | 0.9 | 0.9 | 0.9 | 0.9 | 0.8 | 1 | 0.7 | 0.9 | 1 |
| P3/P1 | 0.5 | 0.5 | 0.5 | 0.7 | 0.8 | 0.7 | 0.7 | 0.3 | 1 |
| Number of fiber bundles constituting sheet | 100 | 100 | 100 | 100 | 100 | 100 | 100 | 100 | 100 |
| Number of fiber bundle blocks | 8 | 5 | 8 | 4 | 5 | 5 | 8 | 8 | — |
| Traveling pitch alteration step-1 | | | | | | | | | |
| Distance (m) between roll (21-1) and roll (22-1) | 1 | 1 | 1 | 1 | 1 | No pitch alteration | 1 | 1 | No pitch alteration |
| θ 1-1 (°) | 0.4 | 0.6 | 0.4 | 0.7 | 1.1 | | 1.1 | 0.4 | |
| Distance (m) between roll (23-1) and roll (24-1) | 1 | 1 | 0.75 | 0.5 | 1 | | 1 | 1 | |
| θ 2-1 (°) | 3 | 3 | 4 | 6 | 6 | | 9 | 3 | |
| Traveling pitch alteration step-2 | | | | | | | | | |
| Distance (m) between roll (21-2) and roll (22-2) | 1 | 1 | 1 | 1 | No pitch alteration | 1 | No pitch alteration | 1 | No pitch alteration |
| θ 1-2 (°) | 1.4 | 2.3 | 1.4 | 1.4 | | 1.7 | | 2.1 | |
| Distance (m) between roll (23-2) and roll (24-2) | 1 | 1 | 0.75 | 0.5 | | 1 | | 1 | |
| θ 2-2 (°) | 11 | 11 | 15 | 11 | | 9 | | 17 | |
| Traveling pitch alteration device | | | | | | | | | |
| Flat roll and grooved roll (two stages) | ○ | ○ | ○ | ○ | ○ | ○ | ○ | ○ | Not used |
| Two grooved rolls (single stage) | | | | | | | | | |
| Productivity | ○ | ○ | ○ | ○ | ○ | ○ | ○ | ○ | x |
| Quality evaluation | ○ (Satisfactory) | ○ (Satisfactory) | ○ (Satisfactory) | ○ (Satisfactory) | ○ (Satisfactory) | ○ (Satisfactory) | x (Fluffing) | x (Fluffing) | ○ (Satisfactory) |

TABLE 1-continued

| | Example 7 | Example 8 | Example 9 | Example 10 | Example 11 | Example 12 |
|---|---|---|---|---|---|---|
| Traveling pitch P1 (mm) in flame-retarding oven | 10 | 10 | 10 | 10 | 10 | 10 |
| Traveling pitch P2 (mm) in precarbonization furnace | 9 | 9 | 9 | 9 | 9 | 9 |
| Traveling pitch P3 (mm) in carbonization furnace | 5 | 5 | 5 | 5 | 5 | 5 |
| P2/P1 | 0.9 | 0.9 | 0.9 | 0.9 | 0.9 | 0.9 |
| P3/P1 | 0.5 | 0.5 | 0.5 | 0.5 | 0.5 | 0.5 |
| Number of fiber bundles constituting sheet | 100 | 100 | 100 | 600 | 600 | 600 |
| Number of fiber bundle blocks | — | 3 | 8 | 8 | 8 | 8 |
| Traveling pitch alteration step-1 | | | | | | |
| Distance (m) between roll (21-1) and roll (22-1) | — | 1 | 1 | 9 | 12 | 15 |
| θ 1-1 (°) | — | 1.0 | 0.4 | 0.2 | 0.2 | 0.1 |
| Distance (m) between roll (23-1) and roll (24-1) | — | 1 | 0.5 | 1 | 1 | 1 |
| θ 2-1 (°) | — | 3 | 6 | 17 | 17 | 17 |
| Traveling pitch alteration step-2 | | | | | | |
| Distance (m) between roll (21-2) and roll (22-2) | — | 1 | 1 | 9 | 12 | 15 |
| θ 1-2 (°) | — | 3.8 | 1.4 | 1.0 | 0.7 | 0.6 |
| Distance (m) between roll (23-2) and roll (24-2) | — | 1 | 0.5 | 5 | 5 | 5 |
| θ 2-2 (°) | — | 11 | 22 | 13 | 13 | 13 |
| Traveling pitch alteration device | | | | | | |
| Flat roll and grooved roll (two stages) | | ○ | ○ | ○ | ○ | ○ |
| Two grooved rolls (single stage) | ○ | | | | | |
| Productivity | ○ | ○ | ○ | ○ | ○ | ○ |
| Quality evaluation | Δ (Twisting) | Δ (Twisting) | Δ (Twisting) | ○ (Satisfactory) | ○ (Satisfactory) | ○ (Satisfactory) |

Hereinafter, the second and third aspects of the present invention are more specifically described on the basis of Examples; however, the method for producing carbon fiber bundles, according to the present invention, is not limited to these Examples. In Examples 13 to 20 and Comparative Examples 4 to 7, the inclination angles of the fiber bundles located at both edges in the sheet-like set of fiber bundles traveling between the roll (113) on the inlet side of the precarbonization furnace and the roll (114) on the outlet side of the precarbonization furnace, shown in FIGS. 6 to 8, in relation to the plane perpendicular to the axes of these two rolls (113 and 114) were designed to be the same angle as each other, and this same angle was the maximum inclination angle (θ11). Additionally, in Examples 13 to 20 and Comparative Examples 4 to 7, the inclination angles of the fiber bundles located at both edges in the sheet-like set of fiber bundles traveling between the roll (115) on the inlet side of the carbonization furnace and the roll (116) on the outlet side of the carbonization furnace, shown in FIGS. 6 to 8, in relation to the plane perpendicular to the axes of these two rolls (115 and 116) were designed to be the same angle as each other, and this same angle was the maximum inclination angle (θ13).

Example 13

A sheet-like set of precursor fiber bundles was prepared by arranging 50 acrylic precursor fiber bundles having a single yarn fineness of 0.8 dTex and a filament number of 24,000 at a pitch of 10 mm at equal intervals on a grooved roll (111). The sheet-like set of precursor fiber bundles traveled zigzag in a flame-retarding oven (51) with the turn-over roll group (119) disposed on the left and right sides of the flame-retarding oven (51) in which hot air at from 230 to 270° C. was circulated, thus a flame-retarding treatment for 50 minutes was performed, and the sheet-like set of precursor bundles was converted into a sheet-like set of flame-retardant fiber bundles. In the flame-retarding oven, no alteration of the traveling pitch of the fiber bundles was performed.

While the sheet-like set of flame-retardant fiber bundles going out from the flame-retarding oven (51) and traveling as lined up side by side in parallel to each other was being altered with respect to the traveling pitch in the precarbonization furnace (52) with use of both the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 8 mm, the sheet-like set of flame-retardant fiber bundles was heat treated for 2 minutes in the precarbonization furnace (52), in which the heat treatment section (52*a*) of the precarbonization furnace was filled with nitrogen and had a temperature distribution of 300 to 600° C., and thus the sheet-like set of flame-retardant fiber bundles was converted into a sheet-like set of precarbonized fiber bundles.

The traveling pitch P11 of the fiber bundles at the inlet and the traveling pitch P12 of the fiber bundles at the outlet of the heat treatment section (52*a*) of the precarbonization furnace, as calculated by the geometrical calculation were 9.9 and 8.1 mm, respectively. The parameters used for the calculation are shown in Table 2.

Here, the inclination angle θ11 of each of the fiber bundles located at both edges of the sheet-like set of precarbonized fiber bundles, in relation to the plane perpendicular to the axis direction of the roll (113) on the inlet side of the precarbonization furnace, was 0.7°.

Next, the sheet-like set of precarbonized fiber bundles was introduced into the carbonization furnace (53), in which the heat treatment section (53*a*) of the carbonization furnace was filled with nitrogen and had a temperature distribution of 1000 to 1500° C., to be heat treated for 2 minutes and thus converted into a sheet-like set of carbonized fiber bundles. In the carbonization furnace, no alteration of the traveling pitch of the fiber bundles was performed, and the fiber bundles were allowed to travel at the pitch of 8 mm. Further, the sheet-like set of carbonized fiber bundles was subjected to an electrolytic oxidation surface treatment and a sizing treatment to be converted into carbon fiber bundles. The carbon fiber bundles were satisfactory in quality and also satisfactory in productivity. The productivity and the quality of the carbon fiber bundles were evaluated on the basis of the following standards.

Productivity

○: The productivity of the carbonization furnace is improved by 10% or more in relation to the case where no traveling pitch alteration was performed.

x: The productivity of the carbonization furnace is improved by less than 10% in relation to the case where no traveling pitch alteration was performed.

Quality

○: The quality of carbon fibers is excellent and absolutely free from problems.

Δ: The quality of carbon fibers is somewhat low, but free from problems.

x: The quality of carbon fibers causes problems.

Example 14

Carbon fiber bundles were prepared under the same conditions as in Example 13 except that the conditions were changed such that the sheet-like set of flame-retardant fiber bundles was altered with respect to the traveling pitch in the precarbonization furnace (2) with use of both the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 6 mm. No alteration of the traveling pitch of the fiber bundles was performed in the flame-retarding oven and the carbonization furnace, and the fiber bundles were allowed to travel in the flame-retarding oven and the carbonization furnace at the pitches of 10 and 6 mm, respectively.

The traveling pitch P11 of the fiber bundles at the inlet and the traveling pitch P12 of the fiber bundles at the outlet of the heat treatment section (52*a*) of the precarbonization furnace as calculated by the geometrical calculation were 9.8 and 6.2 mm, respectively. The inclination angle θ11 of each of the fiber bundles located at both edges of the sheet-like set of precarbonized fiber bundles, in relation to the plane perpendicular to the axis direction of the roll (113) on the inlet side of the precarbonization furnace, was 1.3°. The obtained carbon fiber bundles were satisfactory in quality, and also satisfactory in productivity.

Example 15

Carbon fiber bundles were prepared under the same conditions as in Example 13 except that the conditions were changed such that the sheet-like set of flame-retardant fiber bundles was altered with respect to the traveling pitch in the precarbonization furnace (52) with use of both the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 4 mm. No alteration of the traveling pitch of the fiber bundles was performed in the flame-retarding oven and the carbonization furnace, and the fiber bundles were allowed to travel in the flame-retarding oven and the carbonization furnace at the pitches of 10 and 4 mm, respectively.

The traveling pitch P11 of the fiber bundles at the inlet and the traveling pitch P12 of the fiber bundles at the outlet of the heat treatment section (52*a*) of the precarbonization furnace as calculated by the geometrical calculation were 9.7 and 4.3 mm, respectively. The inclination angle θ11 of each of the fiber bundles located at both edges of the sheet-like set of precarbonized fiber bundles, in relation to the plane perpendicular to the axis direction of the roll (113) on the inlet side of the precarbonization furnace, was 2.0°. The obtained carbon fiber bundles were satisfactory in quality, and also satisfactory in productivity.

Example 16

Carbon fiber bundles were prepared under the same conditions as in Example 13 except that the conditions were changed such that the sheet-like set of flame-retardant fiber bundles was altered with respect to the traveling pitch in the precarbonization furnace (52) with use of both the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 5 mm. No alteration of the traveling pitch of the fiber bundles was performed in the flame-retarding oven and the carbonization furnace, and the fiber bundles were allowed to travel in the flame-retarding oven and the carbonization furnace at the pitches of 10 and 5 mm, respectively.

The traveling pitch P11 of the fiber bundles at the inlet and the traveling pitch P12 of the fiber bundles at the outlet of the heat treatment section (52*a*) of the precarbonization furnace as calculated by the geometrical calculation were 9.5 and 5.5 mm, respectively. The inclination angle θ11 of each of the fiber bundles located at both edges of the sheet-like set of precarbonized fiber bundles, in relation to the plane perpendicular to the axis direction of the roll (113) on the inlet side of the precarbonization furnace, was 3.1°. The obtained carbon fiber bundles were satisfactory in productivity, but part of the fiber bundles showed a quality degradation tendency due to the occurrence of twisting, wherein the degradation tendency was of a level free from problems.

Comparative Example 4

Carbon fiber bundles were prepared under the same conditions as in Example 13 except that the conditions were changed such that the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 10 mm were used, and thus no alteration of the traveling pitch was performed in the precarbonization furnace (52). No alteration of the traveling pitch of the fiber bundles was also performed in the flame-retarding oven and the carbonization furnace, and the fiber bundles were allowed to travel at the pitch of 10 mm in each of the flame-retarding oven and the carbonization furnace.

The obtained carbon fiber bundles were satisfactory in quality, but the productivity in the carbonization step was insufficient as compared to Examples.

Comparative Example 5

Carbon fiber bundles were prepared under the same conditions as in Example 13 except that the conditions were changed such that the sheet-like set of flame-retardant fiber bundles was altered with respect to the traveling pitch in the precarbonization furnace (52) with use of both the roll (113) on the inlet side of the precarbonization furnace, having grooves engraved at equal intervals of a pitch of 10 mm and the roll (114) on the outlet side of the precarbonization furnace, having grooves engraved at equal intervals of a pitch of 3 mm. No alteration of the traveling pitch of the fiber bundles was performed in the flame-retarding oven and the carbonization furnace, and the fiber bundles were allowed to travel in the flame-retarding oven and the carbonization furnace at the pitches of 10 and 3 mm, respectively.

The traveling pitch P11 of the fiber bundles at the inlet and the traveling pitch P12 of the fiber bundles at the outlet of the heat treatment section (52*a*) of the precarbonization furnace as calculated by the geometrical calculation were 9.7 and 3.4 mm, respectively. In this case, the inclination angle θ11 of each of the fiber bundles located at both edges of the sheet-like set of precarbonized fiber bundles, in relation to the plane perpendicular to the axis direction of the roll (113) on the inlet side of the precarbonization furnace, was 2.3°.

Under the aforementioned conditions, because of the occurrence of the cohesion phenomenon probably due to the decomposition gas generated during the precarbonization heat treatment and the occurrence of yarn doubling due to the adjacent fiber bundles at the roll on the outlet side of the precarbonization furnace, it was impossible to obtain carbon fiber bundles satisfactory in quality.

Example 17

A sheet-like set of precursor fiber bundles was prepared by arranging 50 acrylic precursor fiber bundles having a single yarn fineness of 0.8 dTex and a filament number of 24,000 at a pitch of 10 mm at equal intervals on a grooved roll (111). The sheet-like set of precursor fiber bundles was traveled zigzag in a flame-retarding oven (51) with the turn-over roll group (119) disposed on the left and right sides of the flame-retarding oven (51) in which hot air at from 230 to 270° C. was circulated, thus a flame-retarding treatment for 50 minutes was performed, and the sheet-like set of precursor fiber bundles was converted into a sheet-like set of flame-retardant fiber bundles. In the flame-retarding oven, no alteration of the traveling pitch of the fiber bundles was performed.

The sheet-like set of flame-retardant fiber bundles going out from the flame-retarding oven (51) and traveling as lined up side by side in parallel to each other was allowed to travel with an unaltered pitch of 10 mm under the conditions such that the traveling pitch of the sheet-like set of flame-retardant fiber bundles was not altered; the sheet-like set of flame-retardant fiber bundles was heat treated for 2 minutes in the precarbonization furnace (52), in which the heat treatment section (52*a*) of the precarbonization furnace was filled with nitrogen and had a temperature distribution of 300 to 600° C., and thus the sheet-like set of flame-retardant fiber bundles was converted into a sheet-like set of precarbonized fiber bundles.

Next, while the sheet-like set of precarbonized fiber bundles going out from the precarbonization furnace (52) and traveling as lined up side by side in parallel to each other was being altered with respect to the traveling pitch in the carbonization furnace (53) with use of both the roll (115) on the inlet side of the carbonization furnace, having grooves engraved at equal intervals of a pitch of 10 mm and the roll (116) on the outlet side of the carbonization furnace, having grooves engraved at equal intervals of a pitch of 6 mm, the sheet-like set of precarbonized fiber bundles was heat treated for 2 minutes in the carbonization furnace (53), in which the heat treatment section (53*a*) of the carbonization furnace was filled with nitrogen and had a temperature distribution of 1000 to 1500° C., and thus the sheet-like set of precarbonized fiber bundles was converted into a sheet-like set of carbonized fiber bundles.

The traveling pitch P13 of the fiber bundles at the inlet and the traveling pitch P14 of the fiber bundles at the outlet of the heat treatment section (53*a*) of the carbonization furnace as calculated by the geometrical calculation were 9.8 and 6.2 mm, respectively. The parameters used for the calculation are shown in Table 3.

In this case, the inclination angle θ13 of each of the fiber bundles located at both edges of the sheet-like set of carbonized fiber bundles, in relation to the plane perpendicular to the axis direction of the roll (115) on the inlet side of the carbonization furnace, was 1.3°.

Subsequently, the sheet-like set of carbonized fiber bundles was introduced into the graphitization furnace (54), in which the heat treatment section (54*a*) of the graphitization furnace was filled with nitrogen and had a temperature distribution of 1500 to 2500° C., and thus the sheet-like set of carbonized fiber bundles was heat treated for 2 minutes to be converted into a sheet-like set of graphitized fiber bundles. In the graphitization furnace, no alteration of the traveling pitch of the fiber bundles was performed, and the fiber bundles were allowed to travel with the pitch of 6 mm. Further, the sheet-like set of graphitized fiber bundles was subjected to an electrolytic oxidation surface treatment and a sizing treatment to be converted into graphitized fiber bundles. These graphitized fiber bundles were satisfactory in quality and also satisfactory in productivity. The quality and the productivity of these graphitized fiber bundles were evaluated on the basis of the following standards.

Productivity

○: The productivity of the graphitization furnace is improved by 10% or more in relation to the case where no traveling pitch alteration was performed.

x: The productivity of the graphitization furnace is improved by less than 10% in relation to the case where no traveling pitch alteration was performed.

Quality

○: The quality of graphitized fibers is excellent and is absolutely free from problems.

Δ: The quality of graphitized fibers is somewhat low, but free from problems.

x: The quality of graphitized fibers causes problems.

Example 18

Graphitized fiber bundles were prepared under the same conditions as in Example 17 except that the conditions were changed such that the sheet-like set of precarbonized fiber bundles prepared under the same conditions as in Example 13 was altered with respect to the traveling pitch in the carbonization furnace (3) with use of both the roll (115) on the inlet side of the carbonization furnace, having grooves engraved at equal intervals of a pitch of 8 mm and the roll (116) on the outlet side of the carbonization furnace, having grooves engraved at equal intervals of a pitch of 5 mm. No alteration of the traveling pitch of the fiber bundles was performed in the flame-retarding oven and the graphitization furnace, and the fiber bundles were allowed to travel in the flame-retarding oven and the graphitization furnace at the pitches of 10 and 5 mm, respectively.

The traveling pitch P13 of the fiber bundles at the inlet and the traveling pitch P14 of the fiber bundles at the outlet of the heat treatment section (53*a*) of the carbonization furnace as calculated by the geometrical calculation were 7.9 and 5.2 mm, respectively. In this case, the inclination angle θ13 of each of the fiber bundles located at both edges of the sheet-like set of carbonized fiber bundles, in relation to the plane perpendicular to the axis direction of the roll (115) on the inlet side of the carbonization furnace, was 1.0°. The obtained graphitized fiber bundles were satisfactory in quality, and also satisfactory in productivity.

Example 19

Graphitized fiber bundles were prepared under the same conditions as in Example 17 except that the conditions were changed such that the sheet-like set of precarbonized fiber bundles prepared under the same conditions as in Example 14 was altered with respect to the traveling pitch in the carbonization furnace (53) with use of both the roll (115) on the inlet side of the carbonization furnace, having grooves engraved at equal intervals of a pitch of 6 mm and the roll (116) on the outlet side of the carbonization furnace, having grooves engraved at equal intervals of a pitch of 4 mm. No alteration of the traveling pitch of the fiber bundles was performed in the flame-retarding oven and the graphitization furnace, and the fiber bundles were allowed to travel in the flame-retarding oven and the graphitization furnace at the pitches of 10 and 4 mm, respectively.

The traveling pitch P13 of the fiber bundles at the inlet and the traveling pitch P14 of the fiber bundles at the outlet of the heat treatment section (53*a*) of the carbonization furnace as calculated by the geometrical calculation were 5.9 and 4.1 mm, respectively. In this case, the inclination angle θ13 of each of the fiber bundles located at both edges of the sheet-like set of carbonized fiber bundles, in relation to the plane perpendicular to the axis direction of the roll (115) on the inlet side of the carbonization furnace, was 0.7°. The obtained graphitized fiber bundles were satisfactory in quality, and also satisfactory in productivity.

Example 20

Graphitized fiber bundles were prepared under the same conditions as in Example 17 except that the conditions were changed such that the sheet-like set of precarbonized fiber bundles was altered with respect to the traveling pitch in the carbonization furnace (3) with use of both the roll (115) on the inlet side of the carbonization furnace, having grooves engraved at equal intervals of a pitch of 10 mm and the roll (116) on the outlet side of the carbonization furnace, having grooves engraved at equal intervals of a pitch of 5 mm. No alteration of the traveling pitch of the fiber bundles was performed in the flame-retarding oven, the precarbonization furnace and the graphitization furnace, and the fiber bundles were allowed to travel in the flame-retarding oven and the precarbonization furnace at the pitch of 10 mm and to travel in the graphitization furnace at the pitch of 5 mm.

The traveling pitch P13 of the fiber bundles at the inlet and the traveling pitch P14 of the fiber bundles at the outlet of the heat treatment section (53*a*) of the carbonization furnace as calculated by the geometrical calculation were 9.5 and 5.5 mm, respectively. In this case, the inclination angle θ13 of each of the fiber bundles located at both edges of the sheet-like set of precarbonized fiber bundles, in relation to the plane perpendicular to the axis direction of the roll (115) on the inlet side of the carbonization furnace, was 3.1°. The obtained graphitized fiber bundles were satisfactory in productivity, but part of the fiber bundles showed a quality degradation due to the occurrence of twisting, wherein the quality degradation was of a level free from problems.

Comparative Example 6

Graphitized fiber bundles were prepared under the same conditions as in Example 17 except that the conditions were changed such that the roll (115) on the inlet side of the carbonization furnace, having grooves engraved at equal intervals of a pitch of 10 mm and the roll (116) on the outlet side of the carbonization furnace, having grooves engraved at equal intervals of a pitch of 10 mm were used, and thus no alteration of the traveling pitch was performed in the carbonization furnace (53). No alteration of the traveling pitch of the fiber bundles was also performed in the flame-retarding oven, the precarbonization furnace and the graphitization furnace, and the fiber bundles were allowed to travel at the pitch of 10 mm in each of these furnaces and this oven. The obtained graphitized fiber bundles were satisfactory in quality, but the productivity in the carbonization step was insufficient as compared to Examples.

Comparative Example 7

Graphitized fiber bundles were prepared under the same conditions as in Example 17 except that the conditions were changed such that the sheet-like set of precarbonized fiber bundles was altered with respect to the traveling pitch in the carbonization furnace (53) with use of both the roll (115) on the inlet side of the carbonization furnace, having grooves engraved at equal intervals of a pitch of 10 mm and the roll (116) on the outlet side of the carbonization furnace, having grooves engraved at equal intervals of a pitch of 3 mm. No alteration of the traveling pitch of the fiber bundles was performed in the flame-retarding oven, the precarbonization furnace and the graphitization furnace, and the fiber bundles were allowed to travel in the flame-retarding oven and the precarbonization furnace at the pitch of 10 mm and to travel in the graphitization furnace at the pitch of 3 mm.

The traveling pitch P13 of the fiber bundles at the inlet and the traveling pitch P14 of the fiber bundles at the outlet of the heat treatment section (53*a*) of the carbonization furnace as calculated by the geometrical calculation were 9.7 and 3.4 mm, respectively. In this case, the inclination angle θ13 of each of the fiber bundles located at both edges of the sheet-like set of carbonized fiber bundles, in relation to the plane perpendicular to the axis direction of the roll (115) on the inlet side of the carbonization furnace, was 2.3°.

Under the aforementioned conditions, because of the occurrence of yarn doubling due to the adjacent fiber bundles on the roll on the outlet side of the carbonization furnace, it was impossible to obtain carbon fiber bundles satisfactory in quality. The evaluation results of aforementioned Examples and Comparative Examples are shown in Tables 2 and 3.

TABLE 2

| | Example 13 | Example 14 | Example 15 | Example 16 | Comparative Example 4 | Comparative Example 5 |
|---|---|---|---|---|---|---|
| Number of input fiber bundles | 50 | 50 | 50 | 50 | 50 | 50 |
| p1: Pitch (mm) of roll 113 on the inlet side of precarbonization furnace | 10.0 | 10.0 | 10.0 | 10.0 | 10.0 | 10.0 |
| p2: Pitch (mm) of roll 114 on the inlet side of precarbonization furnace | 8.0 | 6.0 | 4.0 | 5.0 | 10.0 | 3.0 |
| P11: Pitch (mm) at inlet of heat treatment section of precarbonization furnace | 9.9 | 9.8 | 9.7 | 9.5 | 10.0 | 9.7 |
| P12: Pitch (mm) at outlet of heat treatment section of precarbonization furnace | 8.1 | 6.2 | 4.3 | 5.5 | 10.0 | 3.4 |
| P12/P11 | 0.82 | 0.63 | 0.44 | 0.58 | 1.00 | 0.35 |
| Distance (m) between rolls | 4.0 | 4.0 | 4.0 | 1.9 | 4.0 | 4.0 |
| a | 0.2 | 0.2 | 0.2 | 0.2 | 0.2 | 0.2 |
| b | 3.6 | 3.6 | 3.6 | 1.5 | 3.6 | 3.6 |
| c | 0.2 | 0.2 | 0.2 | 0.2 | 0.2 | 0.2 |
| Inclination angle θ11(°) | 0.7 | 1.3 | 2.0 | 3.1 | — | 2.3 |
| Productivity | ○ | ○ | ○ | ○ | x | ○ |
| Quality evaluation | ○ (Satisfactory) | ○ (Satisfactory) | ○ (Satisfactory) | Δ (Twisting) | ○ (Satisfactory) | x (Cohesion/yarn doubling) |

TABLE 3

| | Example 17 | Example 18 | Example 19 | Example 20 | Comparative Example 6 | Comparative Example 7 |
|---|---|---|---|---|---|---|
| Number of input fiber bundles | 50 | 50 | 50 | 50 | 50 | 50 |
| p3: Pitch (mm) of roll 115 on the inlet side of carbonization furnace | 10.0 | 8.0 | 6.0 | 10.0 | 10.0 | 10.0 |
| p4: Pitch (mm) of roll 116 on the inlet side of carbonization furnace | 6.0 | 5.0 | 4.0 | 5.0 | 10.0 | 3.0 |
| P13: Pitch (mm) at inlet of heat treatment section of carbonization furnace | 9.8 | 7.9 | 5.9 | 9.5 | 10.0 | 9.7 |
| P14: Pitch (mm) at outlet of heat treatment section of carbonization furnace | 6.2 | 5.2 | 4.1 | 5.5 | 10.0 | 3.4 |
| P14/P13 | 0.63 | 0.66 | 0.69 | 0.58 | 1.00 | 0.35 |
| Distance (m) between rolls | 4.0 | 4.0 | 4.0 | 1.9 | 4.0 | 4.0 |
| d | 0.2 | 0.2 | 0.2 | 0.2 | 0.2 | 0.2 |
| e | 3.6 | 3.6 | 3.6 | 1.5 | 3.6 | 3.6 |
| f | 0.2 | 0.2 | 0.2 | 0.2 | 0.2 | 0.2 |
| Inclination angle θ13(°) | 1.3 | 1.0 | 0.7 | 3.1 | — | 2.3 |
| Productivity | ○ | ○ | ○ | ○ | x | ○ |
| Quality evaluation | ○ (Satisfactory) | ○ (Satisfactory) | ○ (Satisfactory) | Δ (Twisting) | ○ (Satisfactory) | x (Yarn doubling) |

Description of Symbols

1: Flame-retarding oven
2: Precarbonization furnace
3: Carbonization furnace
4: Roll group
5: Roll group
11: Sheet-like set of precursor fiber bundles
12: Sheet-like set of flame-retardant fiber bundles
13: Sheet-like set of precarbonized fiber bundles
14: Sheet-like set of carbon fiber bundles
21: Flat roll
22: Grooved roll
23: Angle-adjustable flat roll
24: Angle-adjustable flat roll
25: Flat roll
26: Grooved roll
27: Grooved roll
31: Sheet-like set of fiber bundles group before division
32: Endmost fiber bundle in a fiber bundle block
B1 to B3: Fiber bundle block
θ1: Maximum inclination angle of fiber bundles in each of fiber bundle blocks with respect to a plane perpendicular to the axes of the flat roll (21) and the grooved roll (22)
θ2: Maximum inclination angle of traveling direction of fiber bundle blocks in the sheet-like set of fiber bundles traveling between the angle-adjustable flat rolls (23 and 24) in relation to a plane perpendicular to the axes of the grooved roll (22) and the flat roll (25)
51: Flame-retarding oven
51*a*: Heat treatment section of flame-retarding oven
52: Precarbonization furnace
52*a*: Heat treatment section of precarbonization furnace
53: Carbonization furnace
53*a*: Heat treatment section of carbonization furnace
54: Graphitization furnace
54*a*: Heat treatment section of graphitization furnace
111: Roll on inlet side of flame-retarding oven
112: Roll on outlet side of flame-retarding oven
113: Roll on inlet side of precarbonization furnace
114: Roll on outlet side of precarbonization furnace
115: Roll on inlet side of carbonization furnace
116: Roll on outlet side of carbonization furnace
117: Roll on inlet side of graphitization furnace
118: Roll on outlet side of graphitization furnace
119: Turn-over roll

What is claimed is:

1. A method for producing carbon fiber bundles, comprising:

a flame-retarding step of converting a plurality of precursor fiber bundles into flame-retardant fiber bundles by heat treating the plurality of precursor fiber bundles in an oxidizing gas atmosphere at from 200 to 300° C. in a state that the plurality of precursor fiber bundles are lined up side by side in parallel to each other;

a precarbonization step of converting the flame-retardant fiber bundles into precarbonization-treated fiber bundles by heat treating the flame-retardant fiber bundles in an inert gas atmosphere with the highest treatment temperature of from 500 to 800° C. in a state that the flame-retardant fiber bundles are lined up side by side in parallel to each other; and a carbonization step of converting the precarbonization-treated fiber bundles into carbon fiber bundles by heat treating the precarbonization-treated fiber bundles in an inert gas atmosphere with the highest treatment temperature of 1000° C. or higher in a state that the precarbonization-treated fiber bundles are lined up side by side in parallel to each other, wherein when a traveling pitch of the fiber bundles in the flame-retarding step is represented by P1, a traveling pitch of the fiber bundles in the precarbonization step is represented by P2, and a traveling pitch of the fiber bundles in the carbonization step is represented by P3, the following relations are satisfied:

$$0.8 \leq P2/P1 \leq 1.0$$

$$0.4 \leq P3/P1 \leq 0.8.$$

2. The method for producing carbon fiber bundles, according to claim 1, further comprising:

(a) a step of making smaller a traveling pitch of fiber bundles present in each of 2 or more and 20 or less fiber bundle blocks, said fiber bundle blocks being subgroups of the flame-retardant fiber bundles obtained from the flame-retarding step, or being subgroups of the precarbonization-treated fiber bundles obtained from the precarbonization step, or being subgroups of each of the flame-retardant fiber bundles and the precarbonization-treated fiber bundles; and (b) a step of bringing adjacent fiber bundle blocks closer to each other, for all the fiber bundle blocks made smaller in the traveling pitch of the fiber bundles in the step (a).

3. The method for producing carbon fiber bundles, according to claim 2, wherein a grooved roll or a comb guide is used in the step (a) for the purpose of decreasing the traveling pitch.

4. The method for producing carbon fiber bundles, according to claim 2, wherein the step (a) is performed with use of two rolls disposed parallel to each other.

5. The method for producing carbon fiber bundles, according to claim 2, wherein in the step (a), at least two rolls disposed parallel to each other are used for decreasing the traveling pitch, wherein a comb guide is used in addition to the two rolls; or a grooved roll is used as at least one of the two rolls.

6. The method for producing carbon fiber bundles, according to claim 2, wherein the step (a) is performed with use of two rolls disposed parallel to each other, wherein the maximum inclination angle of the fiber bundles in each of the fiber bundle blocks traveling between the two rolls, in relation to a plane perpendicular to the axis directions of the two rolls, is set at larger than 0.1° and smaller than 3.0°.

7. The method for producing carbon fiber bundles, according to claim 4, wherein the distance between the two rolls disposed parallel to each other, used in the step (a) is 750 mm or more.

8. The method for producing carbon fiber bundles, according to claim 2, wherein the step (b) is performed with use of a plurality of angle-adjustable second roll pairs disposed between a first roll pair, and;

wherein each of the first roll pair and the second roll pairs consists of two rolls disposed parallel to each other, and the maximum inclination angle among inclination angles of all the fiber bundle blocks traveling between the second roll pairs, in relation to a plane perpendicular to the axes of the two rolls constituting the first roll pair, is set at smaller than 20°.

9. A method for producing carbon fiber bundles, comprising:

a flame-retarding step of converting a multitude of carbon fiber precursor fiber bundles into flame-retardant fiber bundles by heat treating in a flame-retarding oven the multitude of carbon fiber precursor fiber bundles in an oxidizing gas atmosphere at from 200 to 300° C. in a state that the multitude of carbon fiber precursor fiber bundles are lined up side by side;

a precarbonization step of converting the flame-retardant fiber bundles into precarbonization-treated fiber bundles by heat treating in a precarbonization furnace the flame-retardant fiber bundles in an inert gas atmosphere with the highest treatment temperature of from 500 to 800° C. in a state that the flame-retardant fiber bundles are lined up side by side; and a carbonization step of converting the precarbonization-treated fiber bundles into carbon fiber bundles by heat treating in a carbonization furnace the precarbonization-treated fiber bundles in an inert gas atmosphere with the highest treatment temperature of 1000° C. or higher in a state that the precarbonization-treated fiber bundles are lined up side by side, wherein when a traveling pitch of the fiber bundles at the inlet of a heat treatment section of the precarbonization furnace is represented by P11, and a traveling pitch of the fiber bundles at the outlet of the heat treatment section of the precarbonization furnace is represented by P12, the following relation is satisfied:

$$0.40 \leq (P12/P11) \leq 0.90.$$

10. The method for producing carbon fiber bundles according to claim 9, wherein the traveling pitch of the fiber bundles traveling in the heat treatment section of the precarbonization furnace is altered with use of two rolls parallel to each other, respectively disposed on the inlet side and the outlet side of the precarbonization furnace, wherein the maximum inclination angle among inclination angles of the multitude of fiber bundles, lined up side by side, traveling between the two rolls, in relation to a plane perpendicular to the axis directions of the two rolls, is set at larger than 0.1° and smaller than 3.0°.

11. The method for producing carbon fiber bundles according to claim 9, wherein when a traveling pitch of the fiber bundles at the inlet of a heat treatment section of the carbonization furnace is represented by P13, and a traveling pitch of the fiber bundles at the outlet of the heat treatment section of the carbonization furnace is represented by P14, the following relation is satisfied:

$$0.40 \leq (P14/P13) \leq 0.90.$$

12. The method for producing carbon fiber bundles according to claim 11, wherein the traveling pitch of the fiber bundles traveling in the heat treatment section of the carbonization furnace is altered with use of two rolls parallel to each other, respectively disposed on the inlet side and the outlet side of the carbonization furnace, wherein the maximum inclination angle among inclination angles of the multitude of fiber bundles, lined up side by side, traveling between these two rolls, in relation to a plane perpendicular to the axis directions of these two rolls, is set at larger than 0.1° and smaller than 3.0°.

13. A method for producing carbon fiber bundles, comprising:

a flame-retarding step of converting a multitude of carbon fiber precursor fiber bundles into flame-retardant fiber bundles by heat treating in a flame-retarding oven the multitude of carbon fiber precursor fiber bundles in an oxidizing gas atmosphere at from 200 to 300° C. in a state that the multitude of carbon fiber precursor fiber bundles are lined up side by side;

a precarbonization step of converting the flame-retardant fiber bundles into precarbonization-treated fiber bundles by heat treating in a precarbonization furnace the flame-retardant fiber bundles in an inert gas atmosphere with the highest treatment temperature of from 500 to 800° C. in a state that the flame-retardant fiber bundles are lined up side by side; and a carbonization step of converting the precarbonization-treated fiber bundles into carbon fiber bundles by heat treating in a carbonization furnace the precarbonization-treated fiber bundles in an inert gas atmosphere with the highest treatment temperature of 1000° C. or higher in a state that the precarbonization-treated fiber bundles are lined up side by side, wherein when a traveling pitch of the fiber bundles at the inlet of a heat treatment section of the carbonization furnace is represented by P13, and a traveling pitch of the fiber bundles at the outlet of the heat treatment section of the carbonization furnace is represented by P14, the following relation is satisfied:

$$0.40 \leq (P14/P13) \leq 0.90.$$

14. The method for producing carbon fiber bundles according to claim 13, wherein the traveling pitch of the fiber bundles traveling in the heat treatment section of the carbonization furnace is altered with use of two rolls parallel to each other, respectively disposed on the inlet side and the outlet side of the carbonization furnace, wherein the maximum inclination angle among inclination angles of the multitude of fiber bundles, lined up side by side, traveling between the two rolls, in relation to a plane perpendicular to the axis directions of the two rolls, is set at larger than 0.1° and smaller than 3.0°.

* * * * *